United States Patent [19]

Makino et al.

[11] Patent Number: 5,053,302

[45] Date of Patent: Oct. 1, 1991

[54] ELECTROPHOTOGRAPHIC PHOTORECEPTOR CONTAINING AN AZO COMPOUND AND A CHARGE TRANSPORTING MATERIAL

[75] Inventors: Naonori Makino; Satoshi Hoshi; Katsuji Kitatani, all of Kanagawa, Japan

[73] Assignee: Fuji Photo Film Co., Ltd., Kanagawa, Japan

[21] Appl. No.: 523,505

[22] Filed: May 15, 1990

[30] Foreign Application Priority Data

May 15, 1989 [JP] Japan ..... 1-120642

[51] Int. Cl.[5] ..... G03G 5/06

[52] U.S. Cl. ..... 430/58; 430/78; 430/59; 430/70; 430/79

[58] Field of Search ..... 430/58, 78, 79, 70, 430/59

[56] References Cited

U.S. PATENT DOCUMENTS 4,731,315 3/1988 Horie et al. ..... 430/58

4,743,523 5/1988 Yamashita et al. ..... 430/78

*Primary Examiner*—David Welsh

*Assistant Examiner*—S. Rosasco

*Attorney, Agent, or Firm*—Sughrue, Mion, Zinn, Macpeak & Seas

[57] ABSTRACT

A novel electrophotographic photoreceptor is provided comprising on an electrically conductive support a layer containing a charge-transporting compound and a charge-generating compound or a charge-transporting compound-containing layer and a charge-generating compound-containing layer, characterized in that as said electric charge-generating compound there is contained an azo compound containing an organic residue represented by general formula (1):

(1)

wherein $Ar^2$ represents a divalent aromatic hydrocarbon or aromatic heterocyclic group; $Ar^3$ represents an aromatic hydrocarbon group or aromatic heterocyclic group; and Q represents a hydrogen atom, halogen atom, alkyl group, trifluoromethyl group, nitro group, cyano group or alkoxy group. In a preferred embodiment, the azo compound is represented by the general formula (2):

(2)

wherein $Ar^1$ represents an aromatic hydrocarbon group or aromatic heterocyclic group which may be connected thereto via a connecting group; $Ar^2$ and $Ar^3$ are as defined in the general formula (1); and n represents an integer 1 to 4.

13 Claims, No Drawings

ELECTROPHOTOGRAPHIC PHOTORECEPTOR CONTAINING AN AZO COMPOUND AND A CHARGE TRANSPORTING MATERIAL

FIELD OF THE INVENTION

The present invention relates to an electrophotographic photoreceptor comprising an electrophotographic light-sensitive layer containing a novel azo compound.

BACKGROUND OF THE INVENTION

As photoconductive compositions to be incorporated in electrophotographic photoreceptors there have heretofore been well known inorganic substances such as selenium, cadmium sulfide, zinc oxide and amorphous silicon. These inorganic substances are advantageous in that they have excellent electrophotographic properties. In particular, these inorganic substances exhibit an extremely excellent photoconductivity, charge acceptability in a dark place and insulating properties. On the contrary, however, these inorganic substances have various disadvantages. For example, selenium photoreceptors are expensive to manufacture, have no flexibility and cannot withstand thermal or mechanical shock. Cadmium sulfide photoreceptors can cause a pollution problem because cadmium is a toxic substance. Zinc oxide is disadvantageous in that it exhibits a poor image stability after repeated use. Furthermore, amorphous silicon photoreceptors are extremely expensive to manufacture and also require a special surface treatment to prevent surface deterioration thereof.

In recent years, electrophotographic photoreceptors comprising various organic substances have been proposed and some of them have been put into practical use to eliminate these disadvantages of inorganic substances. Examples of these approaches include electrophotographic photoreceptors comprising poly-N-vinylcarbazole and 2,4,7-trinitrofluorenone-9-one as disclosed in U.S. Pat. No. 3,484,237, electrophotographic photoreceptors comprising poly-N-vinylcarbazole sensitized with a pyrilium salt dye as disclosed in JP-B-48-25658 (the term "JP-B" as used herein means an "examined Japanese patent publication"), and electrophotographic photoreceptors comprising as a main component a eutectic complex of a dye and a resin as disclosed in JP-A-47-10375 (the term "JP-A" as used herein means an "unexamined published Japanese patent application").

Furthermore, many active studies and proposals have recently been made on electrophotographic photoreceptors comprising as main components organic pigments such as perylene pigment (as described in U.S. Pat. No. 3,371,884), phthalocyanine pigment (as described in U.S. Pat. Nos. 3,397,086 and 4,666,802), azulenium salt pigment (as described in JP-A-59-53850 and JP-A-59-212542), squalium salt pigment (as described in U.S. Pat. Nos. 4,396,610 and 4,644,082) and polycyclic quinone pigment (as described in JP-A-59-184348 and JP-A-62-28738) or the following azo pigments:

Bisazo pigments as disclosed in JP-A-47-37543, JP-A-56-116039, JP-A-58-123541, JP-A-61-260250, JP-A-61-228453, JP-A-61-275849 and JP-A-61-275850, and JP-B-60-5941 and JP-B-60-45664;

Trisazo pigments as disclosed in U.S. Pat. Nos. 4,436,800 and 4,439,506, and JP-A-53-132347, JP-A-55-69148, JP-A-57-195767, JP-A-57-200045, JP-A-57-204556, JP-A-58-31340, JP-A-58-31341, JP-A-58-154560, JP-A-58-160358, JP-A-58-160359, JP-A-59-127044, JP-A-59-196366, JP-A-59-204046, JP-A-59-204841, JP-A-59-218454, JP-A-60-111249, JP-A-60-111250, JP-A-61-11754, JP-A-61-22346, JP-A-61-35451, JP-A-61-67865, JP-A-61-121059, JP-A-61-163969, JP-A-61-179746, JP-A-61-230157, JP-A-61-251862, JP-A-61-251865, JP-A-61-269164, JP-A-62-21157, JP-A-62-78563 and JP-A-62-115452; and Tetrakisazo pigments as disclosed in U.S. Pat. No. 4,447,513, and JP-A-60-108857, JP-A-60-108858, JP-A-60-111247, JP-A-60-111248, JP-A-60-118843, JP-A-60-176046, JP-A-61-103157, JP-A-61-117559, JP-A-61-182051, JP-A-61- 194447, JP-A-61-196253, JP-A-61-212848, JP-A-61-240246, JP-A 61-273548, JP-A-61-284769, JP-A-62-18565, JP-A-62-18566 and JP-A-62-19873.

These electrophotographic photoreceptors can attain some improvement in the mechanical properties and flexibility of the above described inorganic electrophotographic photoreceptors However, these electrophotographic photoreceptors leave to be desired in sensitivity. These electrophotographic photoreceptors are also disadvantageous in that they may exhibit some change in the electrical properties upon repeated use. Thus, these electrophotographic photoreceptors don't necessarily satisfy the requirements for electrophotographic photoreceptors.

SUMMARY OF THE INVENTION

It is therefore an object of the present invention to provide a novel electrophotographic photoreceptor which exhibits a high sensitivity and durability.

It is another object of the present invention to provide a novel electrophotographic photoreceptor which exhibits a small change in the light-sensitivity upon repeated use.

The above and other objects of the invention will become more apparent from the following detailed description and examples.

These objects of the present invention are accomplished with an electrophotographic photoreceptor comprising on an electrically conductive support a layer containing a charge-transporting compound and a charge-generating compound or a charge-transporting compound-containing layer and a charge-generating compound-containing layer, characterized in that as said charge-generating compound there is contained an azo compound containing an organic residue represented by general formula (1):

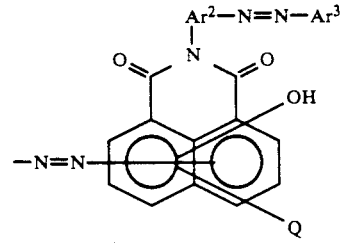

(1)

wherein $Ar^2$ represents a divalent aromatic hydrocarbon or aromatic heterocyclic group; $Ar^3$ represents an aromatic hydrocarbon group or aromatic heterocyclic group; and Q represents a hydrogen atom, halogen atom, alkyl group, trifluoromethyl group, nitro group, cyano group or alkoxy group.

The azo compound represented by general formula (1) is preferably an azo compound represented by general formula (2):

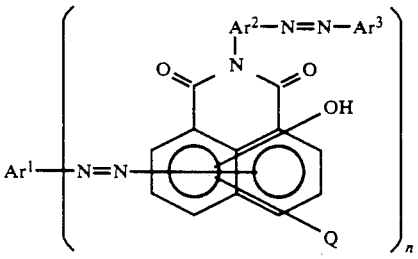

(2)

wherein $Ar^1$ represents an aromatic hydrocarbon group or aromatic heterocyclic group which may be connected to the organic residue via a connecting group; $Ar^2$, $Ar^3$, and Q are as defined in the general formula (1); and n represents an integer 1 to 4.

DETAILED DESCRIPTION OF THE INVENTION

The azo compound represented by general formula (1) will be further illustrated hereafter.

Specific examples of the aromatic hydrocarbon group represented by $Ar^1$ in the general formula (2) include a monovalent monocyclic or condensed polycyclic aromatic hydrocarbon group such as a phenyl group, naphthyl group, 1-pyrenine group, 2-anthryl group, and 5-asenaphthenyl group, divalent monocyclic or condensed polycyclic aromatic hydrocarbon group such as 1,2-phenylene group, 1,3-phenylene group, 1,4-phenylene group, 1,3-naphthylene group, 1,4-naphthylene group, 1,5-naphthylene group, 1,8-naphthylene group, 2,3-naphthylene group, 2,5-naphthylene group, 2,6-naphthylene group, 2,7-naphthylene group, 1,4-anthraquinonylene group, 2,6-anthraquinonylene group, 2,7-fluorenylene group and pyrenylene group, and other divalent group such as biphenylene group.

Specific examples of the aromatic hydrocarbon group represented by $Ar^1$ in the general formula (2) via a connecting group, include divalent groups such as a bisphenylene group represented by the general formula:

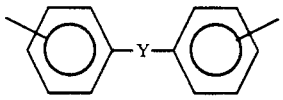

wherein Y (which corresponds to a connecting group) represents —O—, —S—, —S—S—, —SO—, —S02—, —CONH—, —$CH_2$—, —CO—, —CH=CH—, —N=N—, —C=C—, —CH=CH—CH=CH—,

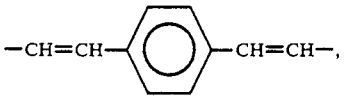

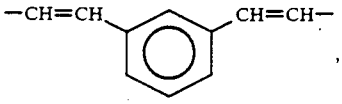

-continued

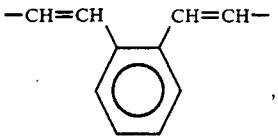

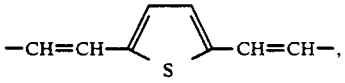

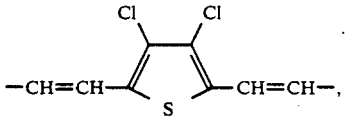

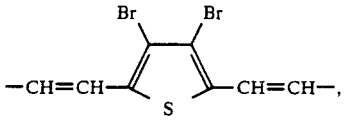

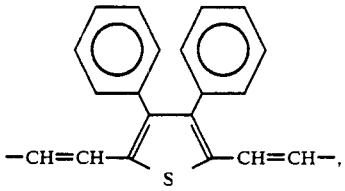

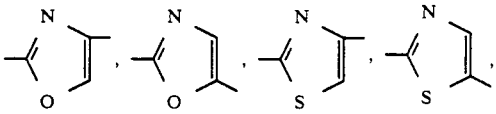

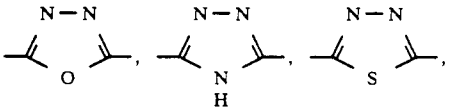

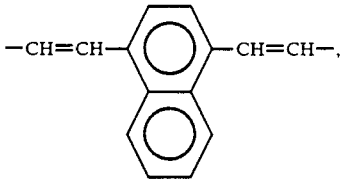

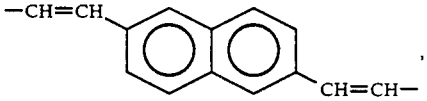

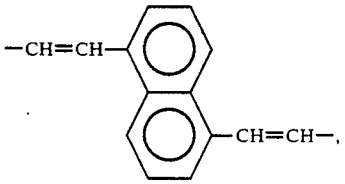

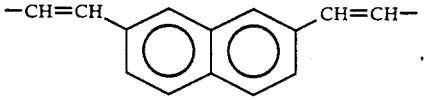

-continued

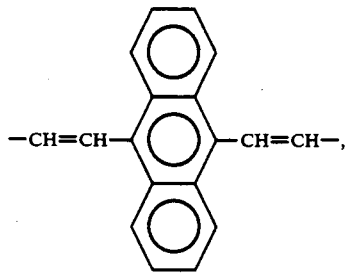

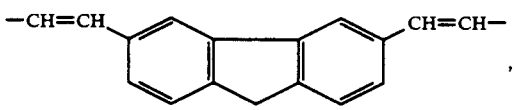

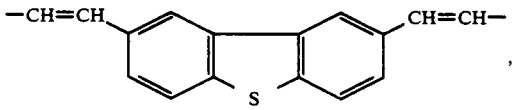

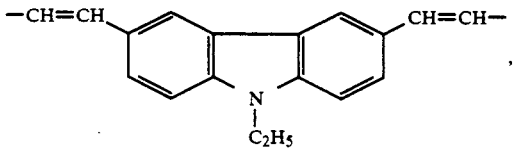

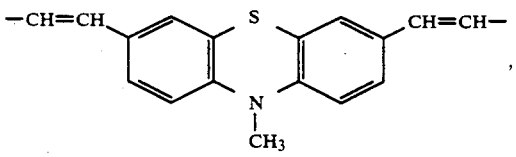

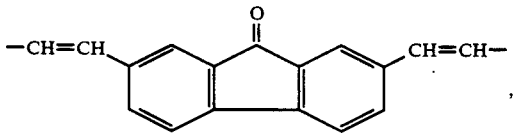

xanthorenine group and fluorenylene group, a trivalent group derived from triphenylamine, triphenylmethane, triphenylphosphine, triphenylphosphine oxide, 9-phenylsulforene and 4-diphenylaminotolan, and a tetravalent L,) group derived from tetraphenylethylene, 4,4'-bis(diphenylamino)stilbene, 4,4'-bis(diphenylamino)tolan, bis-(4-diphenylaminophenyl)methane, 1,1-(4'-diphenylaminophenyl)cyclohexane, 4,4'-diphenylaminophenyl ether, and 4,4'-diphenylaminophenyl thioether.

Specific examples of the aromatic heterocyclic group represented by $Ar^1$ in the general formula (2) include a monovalent 9- to 20-membered heterocyclic group such as naphthoylenebenzimidazolyl group, benzimidazolyl group, benzoxazolyl group, carbazolyl group, benzothiazolyl group, and quinolyl group, a divalent 9- to 20-membered heterocyclic group such as carbazolediil group, benzothiophenediil group, and benzethiopheneoxidediil group, a trivalent group derived from N-phenylcarbazole, N-phenylphenoxazine, N-phenylphenothiazine, triphenyloxazole, triphenylthiazole, triphenylimidazole, and triphenylselenazole, and a tetravalent group derived from 1,2-bis(N-carbazolyl)ethane and 1,4-bis(N-carbazolyl)benzene.

In $Ar^2$ and $Ar^3$, it is preferred that the aromatic hydrocarbon group contains 6 to 18 carbon atoms, the heterocyclic ring is 5 to 16 membered, and the hetero atom is nitrogen atom, oxygen atom or sulfur atom.

Examples of the group represented by $Ar^2$ include an arylene group such as phenylene, naphthalene, anthrylene, biphenylene, and terphenylene, a divalent group derived from an aromatic hydrocarbon group such as an indene, fluorene, acenaphthene, and perylene, a divalent group derived from a condensed polycyclic aromatic group such as fluorenone, anthrone, anthraquinone, benzoanthrone, and isocoumarine, and a divalent group derived from a heterocyclic aromatic group such as pyridine, quinoline, oxazole, thiazole, oxadiazole, benzooxazole, benzoimidazole, benzothiazole, benzotriazole, dibenzofuran, carbazole, and xanthene.

Examples of the group represented by $Ar^3$ include an aromatic hydrocarbon group such as a phenyl group, naphthyl group, anthryl, pyrenyl group, biphenyl group, and azulenyl group, and a heterocyclic aromatic group such as a furyl group, thienyl group, pyridyl group, imidazolyl group, triazolyl group, tetrazolyl group, oxazolyl group, thiazolyl group, quinolyl group, carbazolyl group, benzoxazolyl group, and benzothiazolyl group.

If $Ar^1$, $Ar^2$ or $Ar^3$ contains substituents, specific examples of such substituents include a hydroxyl group, cyano group, nitro group, halogen atom (e.g., fluorine, chlorine, bromine), $C_{1-12}$ alkyl group (e.g., methyl, ethyl, propyl, isopropyl), $C_{1-2}$ alkoxy group (e.g., methoxy, ethoxy, propoxy, butoxy, pentyloxy, isopropoxy, isobutoxy, isoamyloxy, tertbutoxy, neopentyloxy), trifluoromethyl group, trimethylsilyl group, methanesulfonyl group, amino group, $C_{1-12}$ alkylamino group (e.g., methylamino, ethylamino, propylamino), $C_{1-12}$ dialkylamino group (e.g., dimethylamino, diethylamino, N-methyl-N-ethylamino), $C_{6-12}$ arylamino group (e.g., phenylamino, tolylamino), diarylamino group containing two $C_{6-15}$ aryl groups (e.g., diphenylamino), $C_{6-12}$ arylazo group (e.g., phenylazo, chlorophenylazo, fluorophenylazo, bromophenylazo, cyanphenylazo, carboethoxyphenylazo, nitrophenylazo, acetamidephenylazo, methoxyphenylazo, methylphenylazo, n-octylphenylazo, trifluoromethylphenylazo, trimethylsilylphenylazo, methanesulfonylphenylazo), carboxyl group, alkoxycarbonyl group containing $C_{1-18}$ alkoxy group (e.g., methoxycarbonyl, ethoxycarbonyl), aryloxycarbonyl group containing $C_{6-16}$ aryloxy group (e.g., phenoxycarbonyl, naphthoxycarbonyl), carboxylate of alkaline metal (examples of alkaline metal cations include $Na^{\ominus}$, $Ke^{\ominus}$, and $Li^{\ominus}$), sulfonate of alkaline metal (examples of alkaline metal cations include $Na^{\ominus}$, $K^{\ominus}$, and $Li^{\ominus}$), alkylcarbonyl group (e.g., acetyl, propionyl, benzylcarbonyl), arylcarbonyl group containing $C_{6-12}$ aryl group (e.g., benzoyl, toluoyl), $C_{1-2}$ alkylthio group (e.g , methylthio, ethylthio), and Cl-!z arylthio group (e.g., phenylthio, tolylthio). These substituents may be used singly or in combination. If a plurality of substituents are connected to $Ar^1$, $Ar^2$ or $Ar^3$, they may be the same or different and may be connected to any positions.

In the case of the aromatic hydrocarbon or heterocyclic group represented by $Ar^1$ in the general formula (1), examples of substituents which may be contained therein include substituted azo groups represented by the general formula (3):

$$-N=N-Cp \qquad (3)$$

wherein Cp represents a known coupler residue which reacts with a diazonium salt. Cp is preferably a known coupler residue in an azo compound used as a charge-generating compound for electrophotographic photoreceptor. Particularly preferred among couplers represented by Cp are those represented by the general formulae (4), (5), (6), (7), (8), (9) and (10):

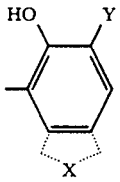
(4)

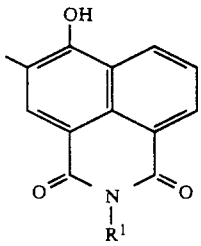
(5)

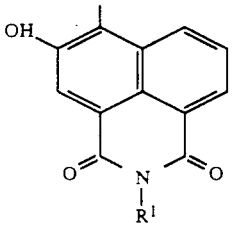
(6)

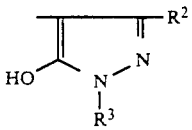
(7)

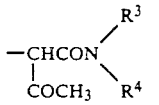
(8)

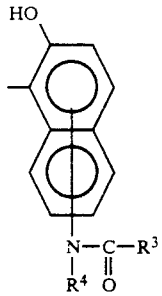
(9)

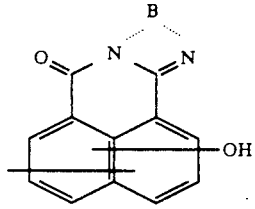
(10)

wherein X represents an atomic group required to be condensed with the benzene ring to which the hydroxyl group and Y are connected to form an aromatic ring such as naphthalene ring and anthracene ring or a heterocyclic ring such as indole ring, carbazole ring, benzocarbazole ring and dibenzofuran ring.

If X is an aromatic ring or heterocyclic group containing substituents, examples of such substituents include a halogen atom (e.g., fluorine, chlorine, bromine), $C_{1-18}$ alkyl group (e.g., methyl, ethyl, propyl, butyl, dodecyl, octadecyl, isopropyl, isobutyl), trifluoromethyl group, nitro group, amino group, cyano group, and $C_{1-8}$ alkoxy group (e.g., methoxy, ethoxy, butoxy). These substituents can be used singly or in combination and can substitute at any positions.

Y represents $—CONR^3R^4$, $—CONHN=CR^3R^4$,—$COOR^3$ or a 5- or 6-membered heterocyclic group which may contain substituents.

$R^1$ represents a $C_{1-12}$ alkyl or phenyl group.

If $R^1$ is an unsubstituted alkyl group, specific examples of such an unsubstituted alkyl group include a methyl group, ethyl group, propyl group, butyl group, pentyl group, hexyl group, isopropyl group, isobutyl group, isoamyl group, isohexyl group, neopentyl group and tert-butyl group.

If $R^1$ is a substituted alkyl group, examples of Substituents include a hydroxyl group, $C_{1-2}$ alkoxy group, Cyano group, amino group, $C_{1-12}$ alkylamino group, dialkylamino group containing two $C_{1-12}$ groups, halogen atom, and $C_{6-15}$ aryl group. Examples of such a substituted alkyl group include a hydroxylalkyl group (e.g., hydroxylmethyl, 2-hydroxyethyl, 3-hydroxypropyl, 2-hydroxypropyl), alkoxyalkyl group (e.g., methoxymethyl, 2-methoxyethyl, 3-methoxypropyl, ethoxymethyl, 2-ethoxyethyl), cyanoalkyl group (e.g., cyanomethyl, 2-cyanoethyl), aminoalkyl group (e.g., aminomethyl, 2-aminoethyl, 3-aminomethyl), (alkylamino)alkyl group (e.g., (methylamino)methyl, 2-(methylamino)ethyl, (ethylamino)methyl), (dialkylamino)alkyl group (e.g., (dimethylamino)methyl, 2-(dimethylamino)ethyl), halogenoalkyl group (e.g., fluoromethyl, trifluoromethyl, chloromethyl), and aralkyl group (e.g., benzyl, phenethyl).

If $R^1$ is a substituted phenyl group, examples of substituents which can be contained in such a substituted phenyl group include a hydroxyl group, $C_{1-12}$ alkoxy group, cyano group, amino group, $C_{1-12}$ alkylamino group, dialkylamino group containing two $C_{1-12}$ alkyl groups, halogen atom, $C_{1-12}$ alkyl group, nitro group and trifluoromethyl group. Examples of such a substituted phenyl group include a hydroxyphenyl group, alkoxyphenyl group (e.g., methoxyphenyl, ethoxyphenyl), cyanophenyl group, aminophenyl group, (alkylamino)phenyl group (e.g., methylamino)phenyl, (ethylamino)phenyl), (dialkylamino)phenyl group (e.g., (dimethylamino)phenyl, (diethylamino)phenyl), halogenophenyl group (e.g., fluorophenyl, chlorophenyl, bromophenyl), alkylphenyl group (e.g., tolyl, ethylphenyl, cumenyl, xylyl, mesityl), nitrophenyl group, trifluoromethylphenyl group, and phenyl group containing two or three such substituents (which may be the same or different). These substituents may substitute at any positions.

Preferred examples of the group represented by $R^2$ include a hydrogen atom, $C_{1-6}$ lower alkyl group, carbamoyl group, carboxyl group, alkoxycarbonyl group containing $C_{1-12}$ alkoxy group, aryloxycarbonyl group containing $C_{6-2o}$ aryloxy group, and substituted or unsubstituted amino group.

If $R^2$ is a substituted amino group, specific examples of such a substituted amino group include a methylamino group, ethylamino group, propylamino group, phenylamino group, tolylamino group, benzylamino group, diethylamino group and diphenylamino group.

If $R^2$ is a lower alkyl group, specific examples of such a lower alkyl group include a methyl group, ethyl group, propyl group, butyl group, isopropyl group and isobutyl group.

If $R^2$ is an alkoxycarbonyl group, specific examples of such an alkoxycarbonyl group include a methoxycarbonyl group, ethoxycarbonyl group, propoxycarbonyl group, butoxycarbonyl group, isopropoxycarbonyl group and benzyloxycarbonyl group.

If $R^2$ is an aryloxycarbonyl group, specific examples of such an aryloxycarbonyl group include a phenoxycarbonyl group and toluoxycarbonyl group.

Preferred examples of the group represented by $R^3$ include $C_{1-20}$ alkyl group, aromatic hydrocarbon group such as phenyl group and naphthyl group, an aromatic heterocyclic group such as dibenzofuranyl group, carbazolyl group and dibenzocarbazolyl group, and compounds obtained by substituting these groups by substituents.

If $R^3$ is a substituted or unsubstituted alkyl group, specific examples of such a substituted or unsubstituted alkyl group include those described with reference to the substituted or unsubstituted alkyl group represented by $R^1$.

If $R^3$ is an aromatic hydrocarbon group or aromatic heterocyclic group containing substituents, specific examples of substituents which can be contained in such a substituted aromatic hydrocarbon or aromatic heterocyclic group include a hydroxyl group, cyano group, nitro group, halogen atom (e.g., fluorine, chlorine, bromine), $C_{1-12}$ alkyl group (e.g., methyl, ethyl, propyl, isopropyl), $C_{1-12}$ alkoxy group (e.g., methoxy, ethoxy, propoxy, butoxy, pentyloxy, isopropoxy, isobutoxy, isoamyloxy, tert-butoxy, neopentyloxy), trifluoromethyl group, trimethylsilyl group, methanesulfonyl group, amino group, $C_{1-12}$ alkylamino L. group (e.g., methylamino, ethylamino, propylamino), $C_{1-2}$ dialkylamino group (e.g., dimethylamino, diethylamino, N-methyl-N-ethylamino), $C_{6-12}$ arylamino group (e.g., phenylamino, tolylamino), diarylamino group containing two $C_{6-15}$ aryl groups (e.g., diphenylamino), carboxyl group, carboxylate of alkaline metal (examples of alkaline metal cations include $Na^{\ominus}$, $K^{\ominus}$ and $Li^{\ominus}$), sulfonate of alkaline metal (examples of alkaline metal cations include $Na^{\ominus}$, $Ke^{\ominus}$ and $Li^{\ominus}$), alkylcarbonyl group (e.g., acetyl, propionyl benzylcarbonyl), arylcarbonyl group containing $C_{6-12}$ aryl groups (e.g., benzoyl, toluoyl), $C_{1-12}$ alkylthio group (e.g., methylthio, ethylthio), and $C_{1-12}$ arylthio group (e.g., phenylthio, tolylthio). The hydrocarbon, aromatic hydrocarbon or aromatic heterocyclic group can contain 1 to 5 such substituents. If a plurality of such substituents are connected to the aromatic hydrocarbon or aromatic heterocyclic group, they may be the same or different. These substituents may substitute at any positions.

Examples of the group represented by $R^4$ include hydrogen atom and those described with reference to $R^3$.

If Y represents an unsubstituted 5- or 6-membered heterocyclic group, specific examples of such an unsubstituted 5- or 6-membered heterocyclic group include an imidazole ring, oxazole ring, thiazole ring, benzoimidazole ring, benzothiazole ring, benzoxazole ring, pyrimidine ring and perimidine ring.

If Y represents a 5- or 6-membered heterocyclic group containing substituents, specific examples of such substituents include those described with reference to $R^3$ wherein $R^3$ is an aromatic hydrocarbon group containing substituents.

If Cp is 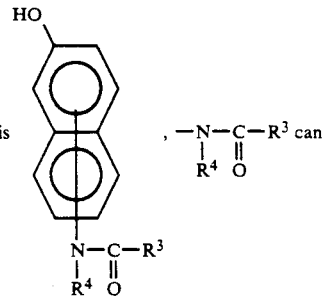

substitute at the 3- to 8-position, preferably 8-position, of the naphthalene ring.

B represents a divalent aromatic hydrocarbon group or nitrogen-containing heterocyclic group, it may be substituted by an alkyl group, halogen atom, nitro group, trifluoromethyl group, cyano group or hydroxy group. Examples of such a divalent aromatic hydrocarbon group include an o-phenylene group, o-naphthylene group, peri-naphthylene group, 1,2-anthraquinolylene group, and 9,10-phenantrylene group. Examples of such a nitrogen-containing heterocyclic group include 3,4-pyrazolediil group, 2,3-pyridiil group, 4,5-pyrimidinediil group, 6,7-indazolediil group, 5,6-benzimidazolediil group and 6,7-quinolinediil group.

Examples of the group represented by Q in formulae (1) and (2) include a hydrogen atom (e.g., fluorine, chlorine, bromine), $C_{1-18}$ alkyl group (e.g., methyl, ethyl, propyl, butyl, dodecyl, octadecyl, isopropyl, isobutyl), trifluoromethyl group, nitro group, amino group, cyano group and $C_{1-8}$ alkoxy group (e.g., methoxy, ethoxy, butoxy). Any number of Q's can substitute on carbon atoms in any positions in the organic residue of the general formula (1).

Typical examples of the azo compound containing an organic residue of the general formula (1) will be set forth in Table 1 below, but the present invention should not be construed as being limited thereto.

In these typical examples, A indicates a residue wherein the residue represented by the general formula (1) is represented by —N=N-A. Specific examples of A will be set forth in Table 2.

TABLE 1
| Compound Group No. | |
|---|---|
| 1-1 | 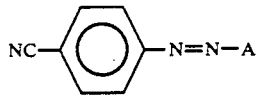 |
| 1-2 | 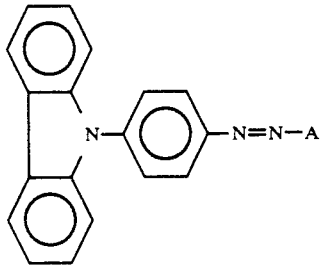 |
| 1-3 | 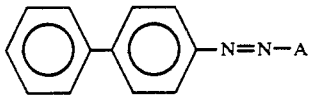 |
| 1-4 | 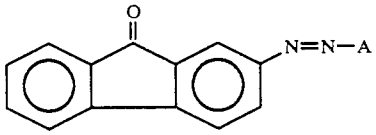 |
| 1-5 | 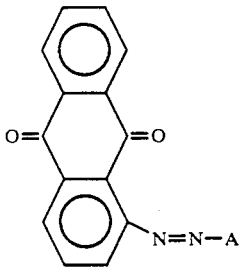 |
| 1-6 | 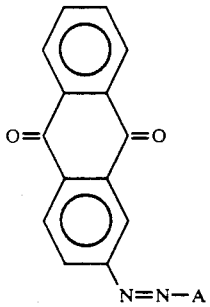 |
| 1-7 | 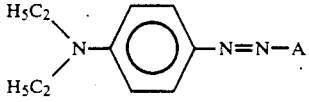 |
| 1-8 | 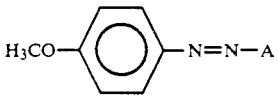 |

TABLE 1-continued
| Compound Group No. | |
|---|---|
| 1-9 | 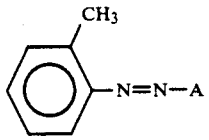 |
| 1-10 | 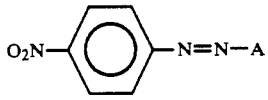 |
| 1-11 | 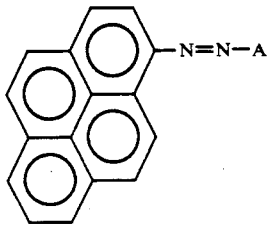 |
| 1-12 | 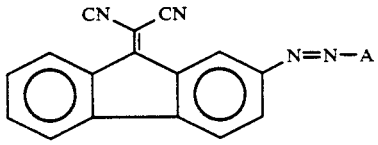 |
| 1-13 | 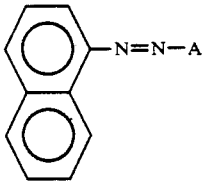 |
| 1-14 | 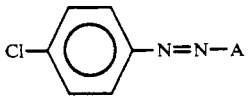 |
| 1-15 | 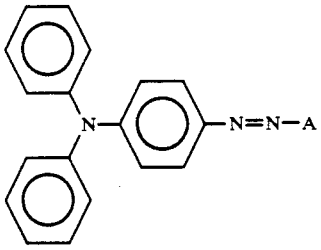 |
| 1-16 | 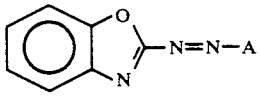 |
| 1-17 | 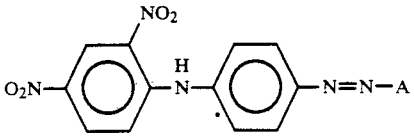 |
| 1-18 | 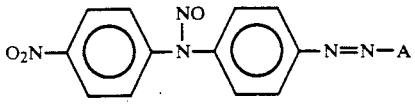 |

TABLE 1-continued
| Compound Group No. | |
|---|---|
| 1-19 | 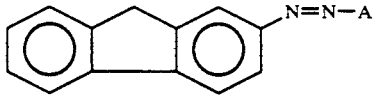 |
| 1-20 | 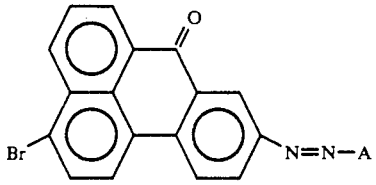 |
| 1-21 | 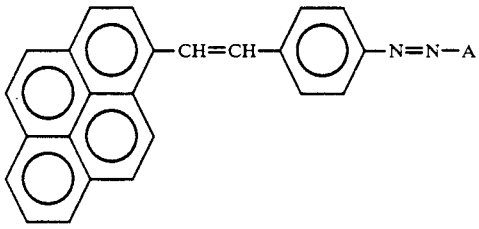 |
| 2-1 | 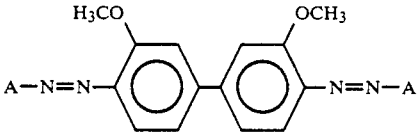 |
| 2-2 | 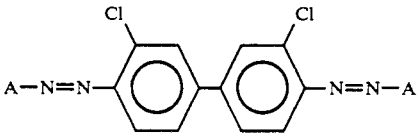 |
| 2-3 | 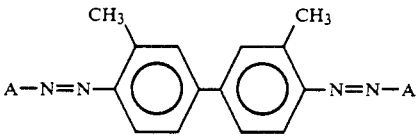 |
| 2-4 | 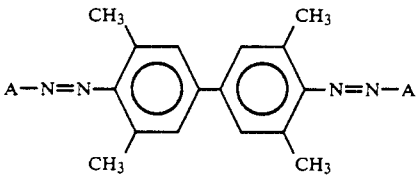 |
| 2-5 | 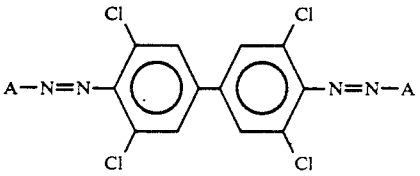 |
| 2-6 | 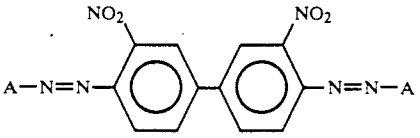 |

TABLE 1-continued
| Compound Group No. | |
|---|---|
| 2-7 | 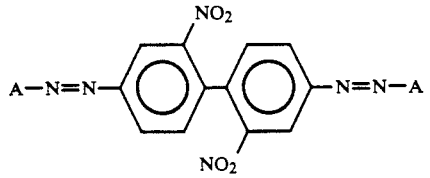 |
| 2-8 | 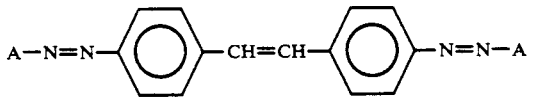 |
| 2-9 | 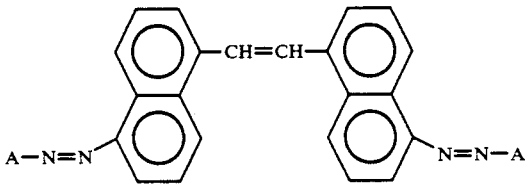 |
| 2-10 | 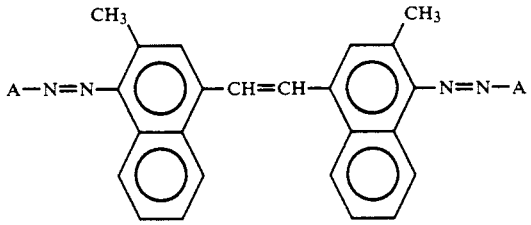 |
| 2-11 | 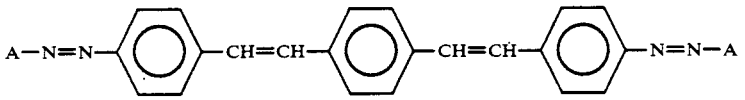 |
| 2-12 | 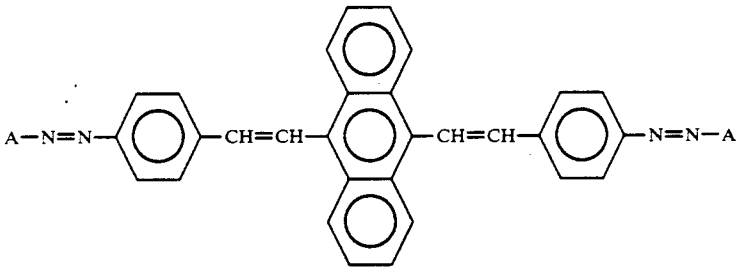 |
| 2-13 | 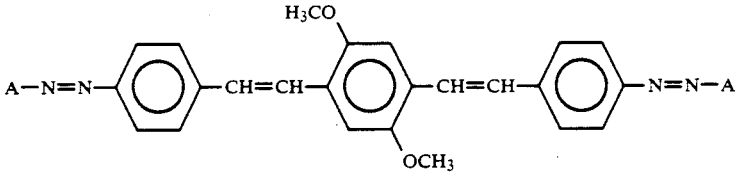 |
| 2-14 | 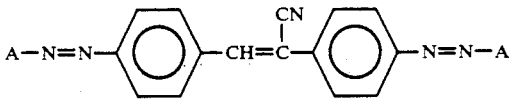 |
| 2-15 | 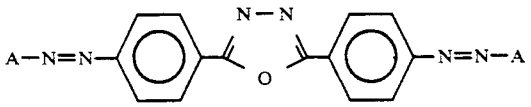 |

TABLE 1-continued
| Compound Group No. | |
|---|---|
| 2-16 | 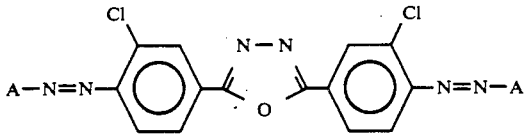 |
| 2-17 | 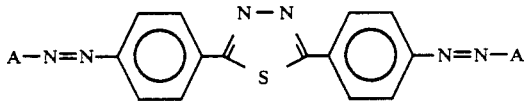 |
| 2-18 | 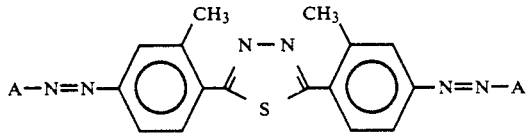 |
| 2-19 | 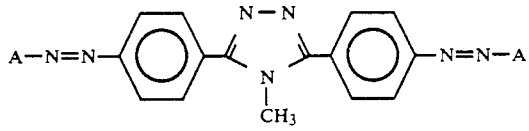 |
| 2-20 | 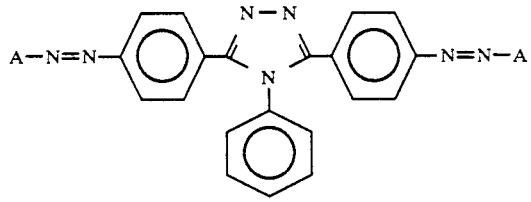 |
| 2-21 | 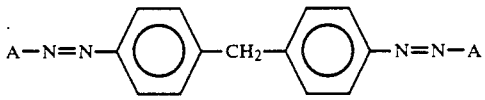 |
| 2-22 | 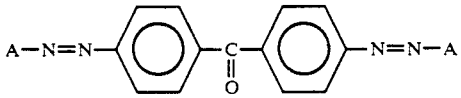 |
| 2-23 | 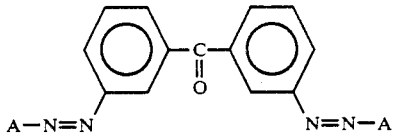 |
| 2-24 | 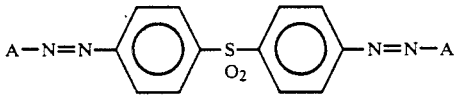 |
| 2-25 | 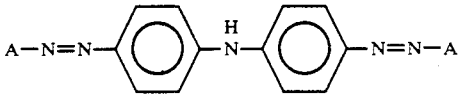 |
| 2-26 | 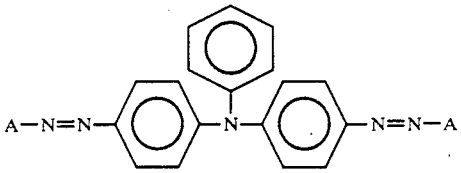 |

TABLE 1-continued
| Compound Group No. | |
|---|---|
| 2-27 | 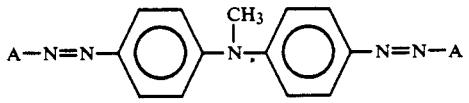 |
| 2-28 | 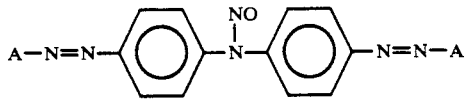 |
| 2-29 | 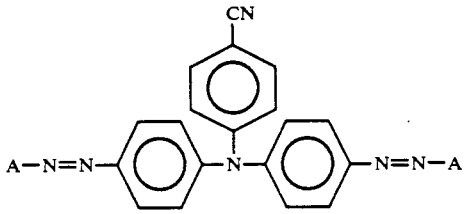 |
| 2-30 | 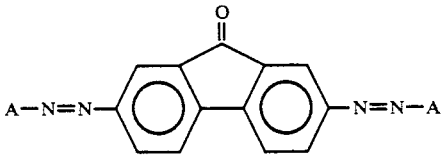 |
| 2-31 | 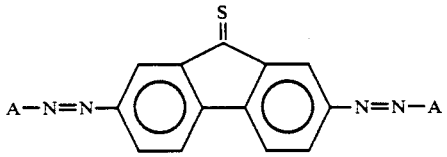 |
| 2-32 | 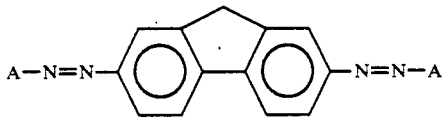 |
| 2-33 | 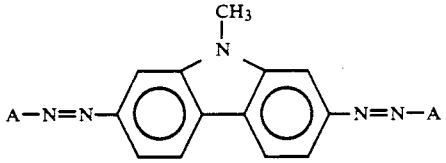 |
| 2-34 | 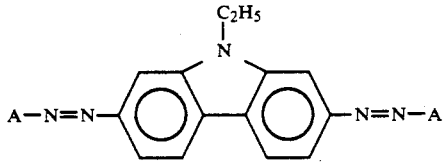 |
| 2-35 | 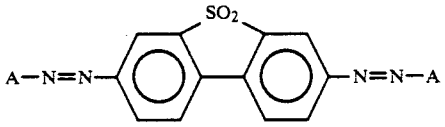 |
| 2-36 | 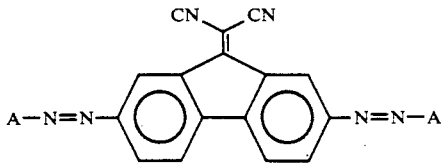 |

TABLE 1-continued
| Compound Group No. | |
|---|---|
| 2-37 | 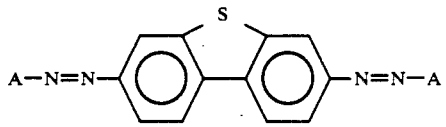 |
| 2-38 | 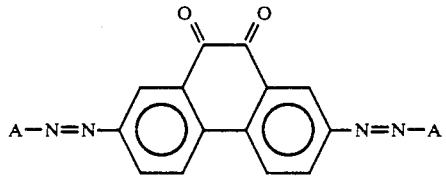 |
| 2-39 | 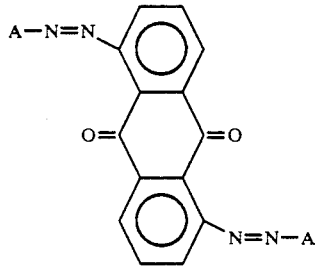 |
| 2-40 | 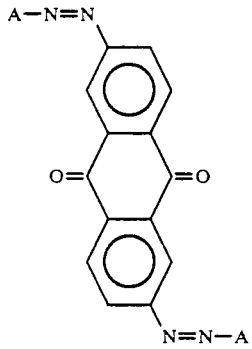 |
| 2-41 | 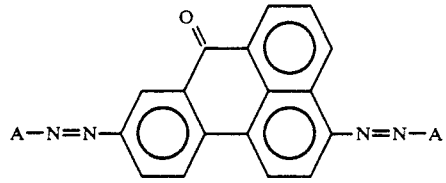 |
| 2-42 | 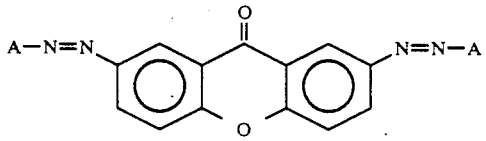 |
| 2-43 | 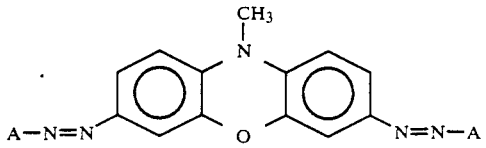 |

TABLE 1-continued
| Compound Group No. | |
|---|---|
| 2-44 | 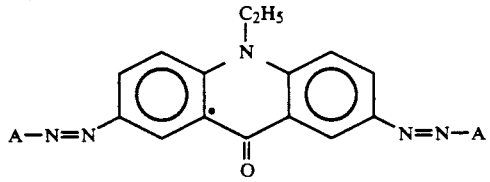 |
| 2-45 | 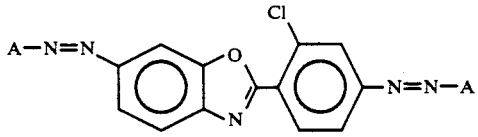 |
| 2-46 | 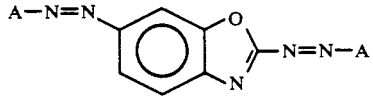 |
| 2-47 | 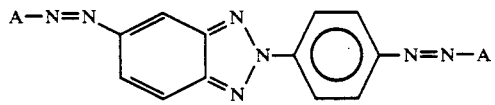 |
| 2-48 | 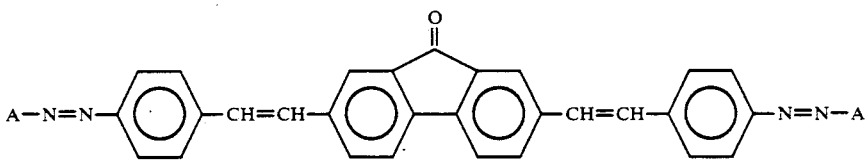 |
| 2-49 | 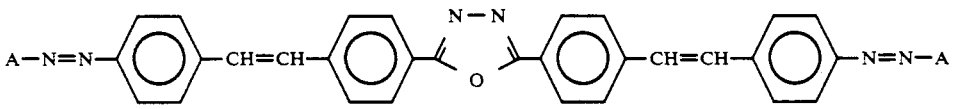 |
| 2-50 | 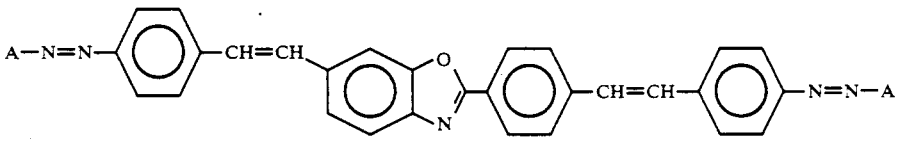 |
| 2-51 | 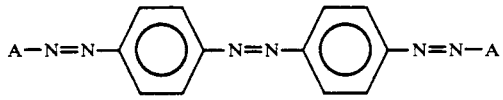 |
| 2-52 | 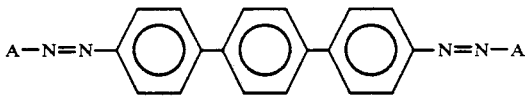 |
| 2-53 | 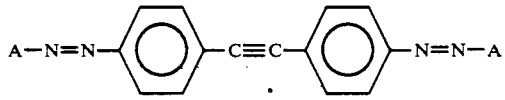 |
| 2-54 | 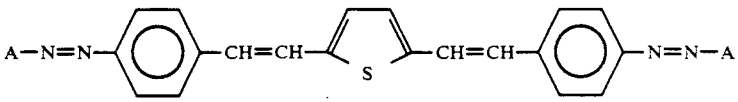 |

TABLE 1-continued
| Compound Group No. | |
|---|---|
| 2-55 | 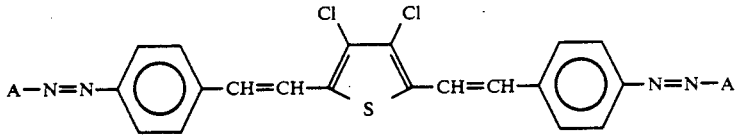 |
| 2-56 | 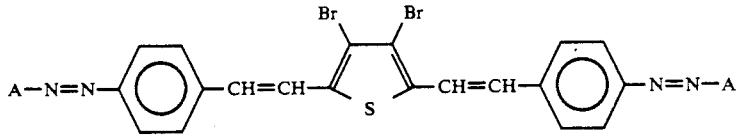 |
| 2-57 | 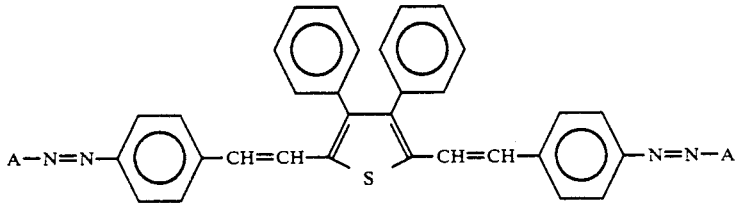 |
| 2-58 | 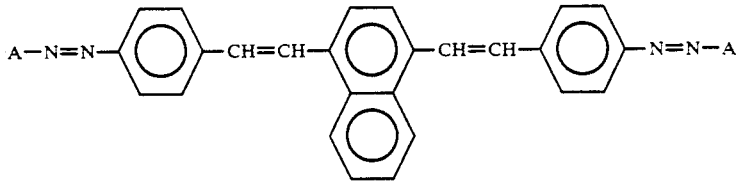 |
| 2-59 | 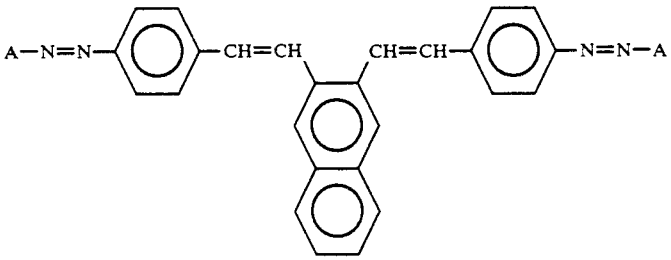 |
| 2-60 | 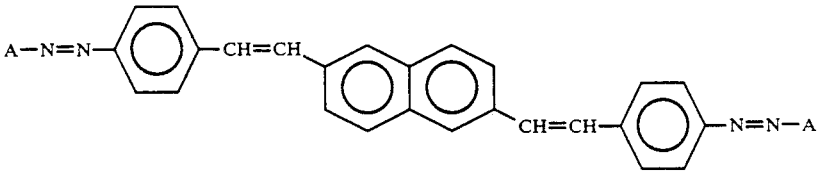 |
| 2-61 | 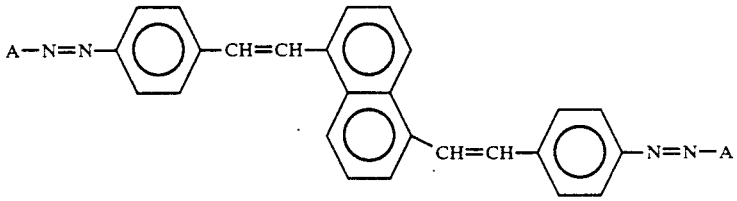 |
| 2-62 | 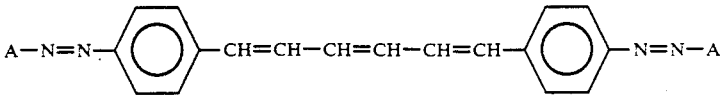 |

TABLE 1-continued
| Compound Group No. | |
|---|---|
| 2-63 | 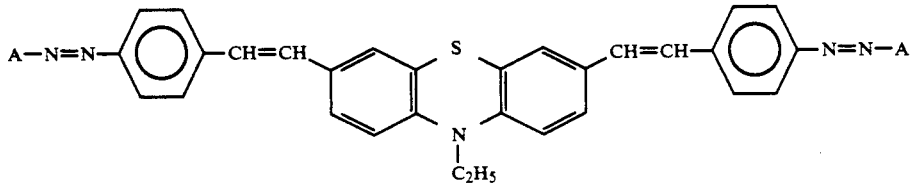 |
| 2-64 | 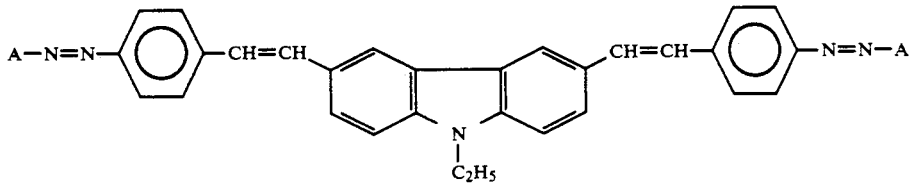 |
| 3-1 | 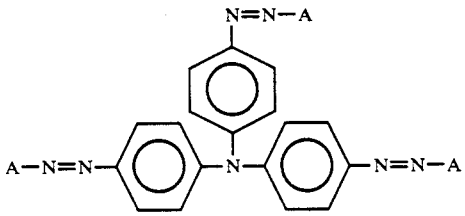 |
| 3-2 | 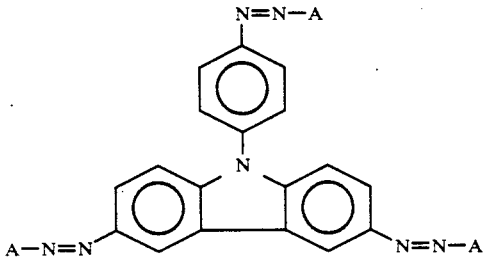 |
| 3-3 | 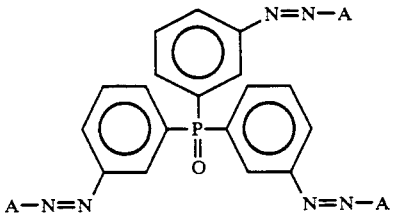 |
| 3-4 | 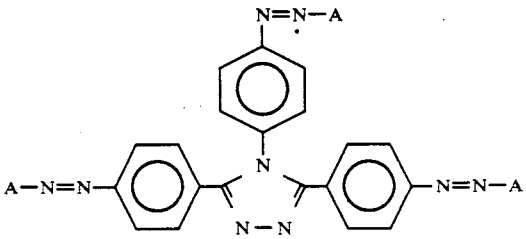 |

TABLE 1-continued
| Compound Group No. | |
|---|---|
| 3-5 | 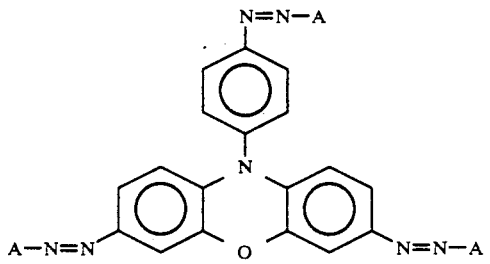 |
| 3-6 | 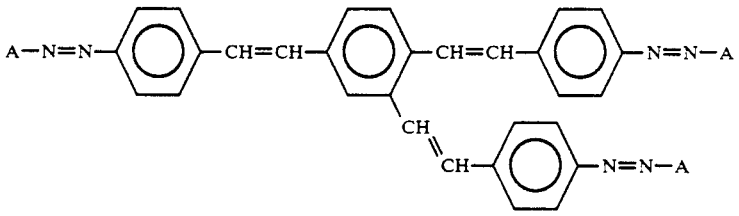 |
| 3-7 | 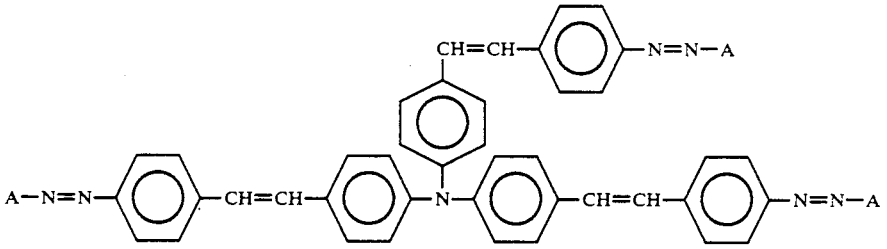 |
| 3-8 | 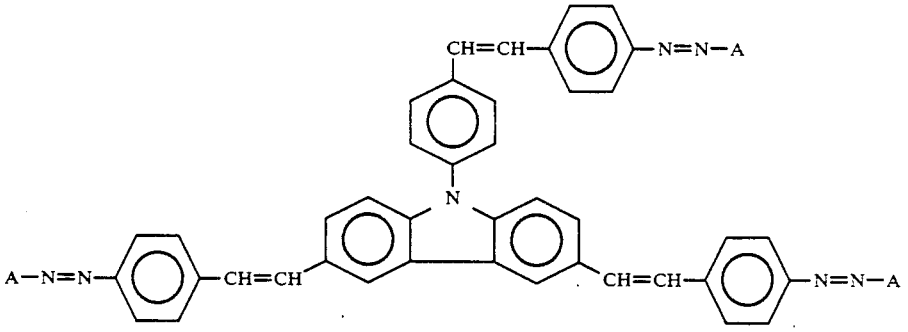 |
| 3-9 | 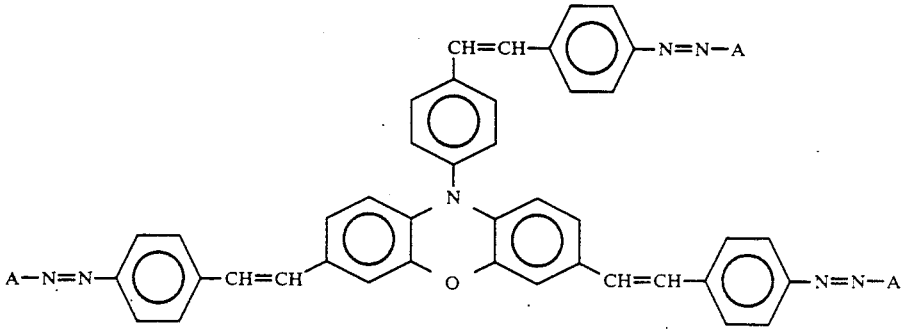 |

TABLE 1-continued
| Compound Group No. | |
|---|---|
| 3-10 | 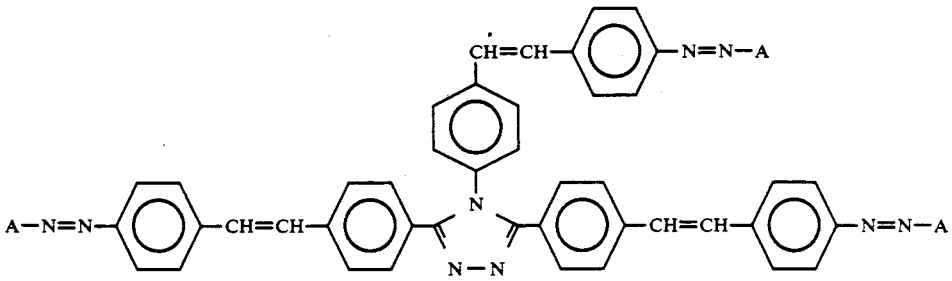 |
| 3-11 | 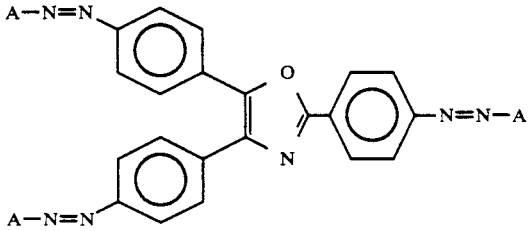 |
| 3-12 | 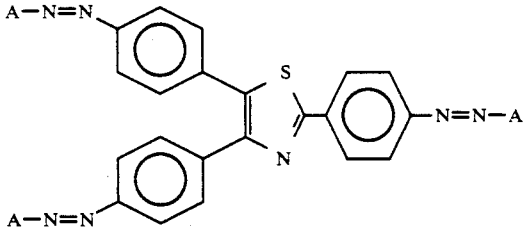 |
| 3-13 | 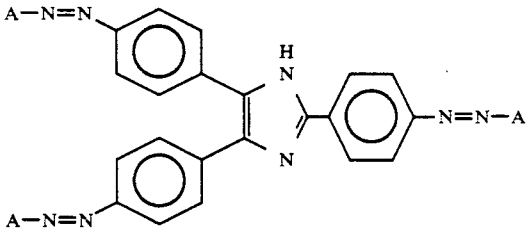 |
| 3-14 | 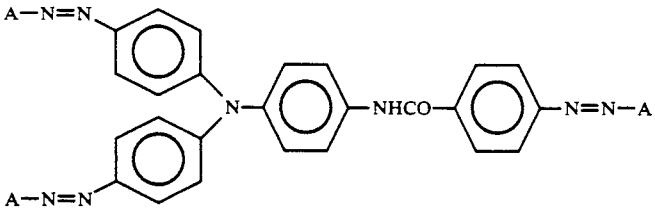 |
| 3-15 | 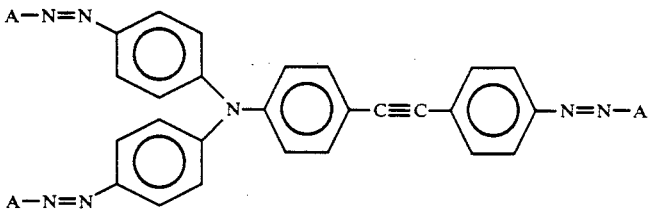 |

TABLE 1-continued
| Compound Group No. | |
|---|---|
| 3-16 | 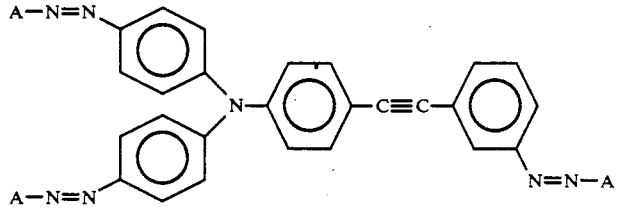 |
| 3-17 | 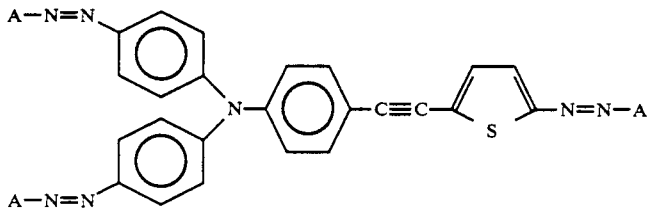 |
| 3-18 | 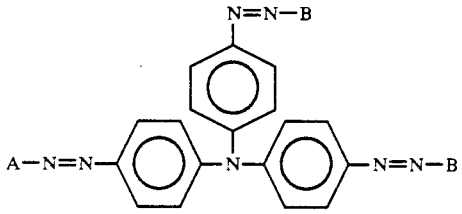 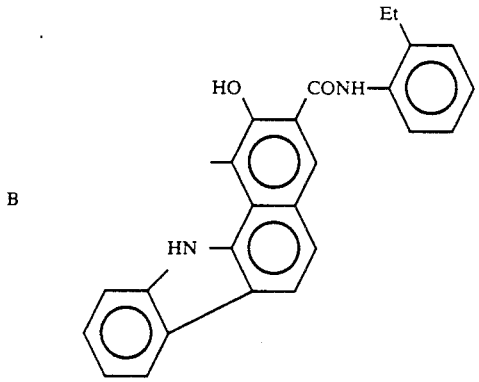 |
| 3-19 | 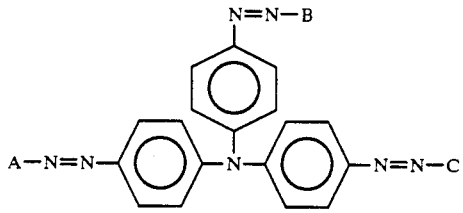 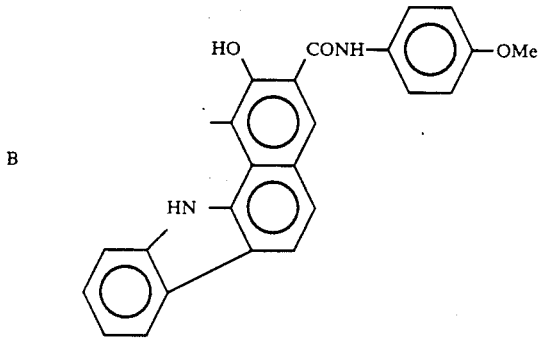 |

TABLE 1-continued
| Compound Group No. | |
|---|---|
| | C 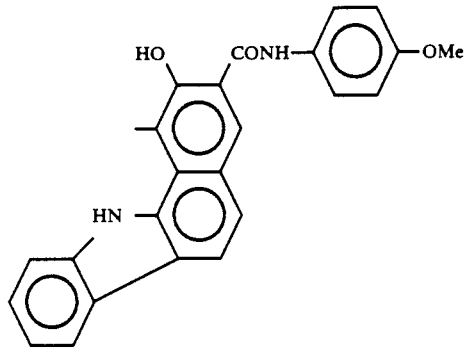 |
| 3-20 | 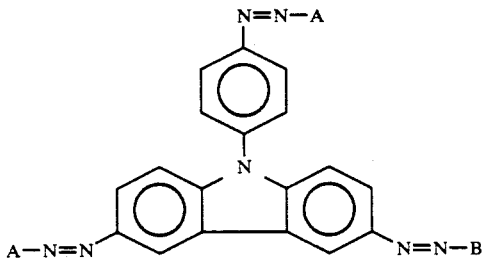 |
| | B 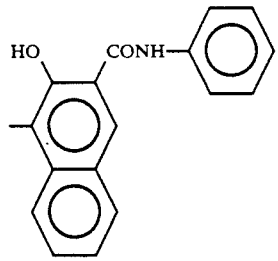 |
| 4-1 | 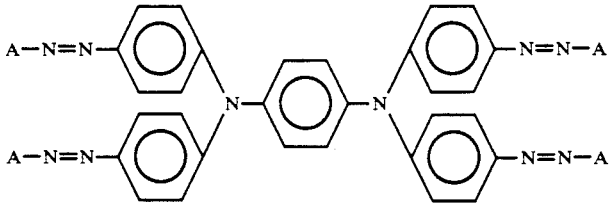 |
| 4-2 | 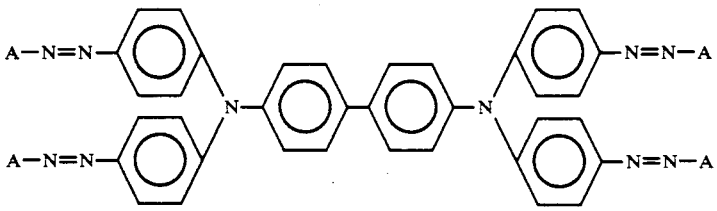 |
| 4-3 | 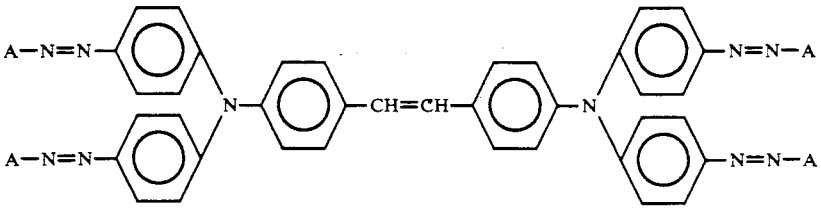 |

TABLE 1-continued
| Compound Group No. | |
|---|---|
| 4-4 | 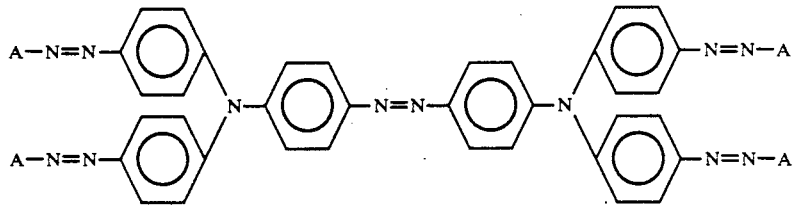 |
| 4-5 | 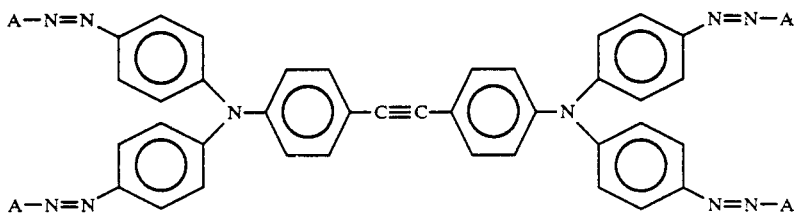 |
| 4-6 | 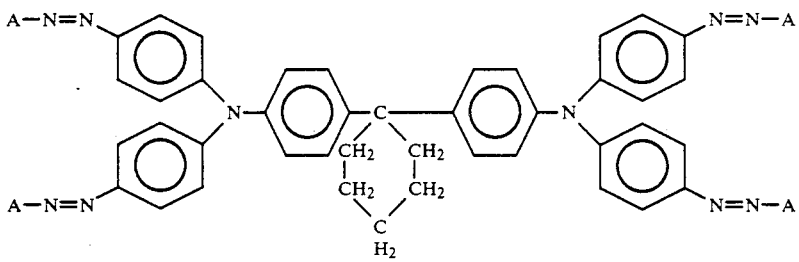 |
| 4-7 | 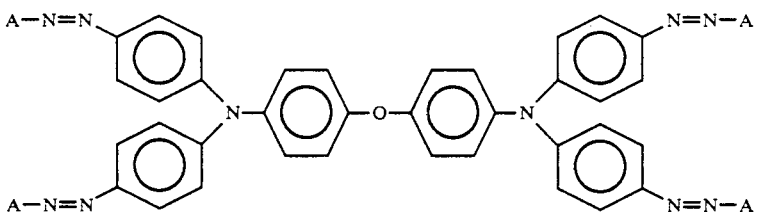 |
| 4-8 | 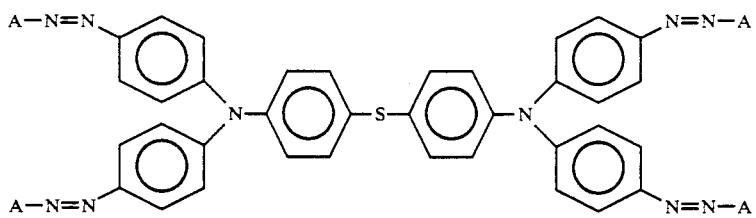 |
| 4-9 | 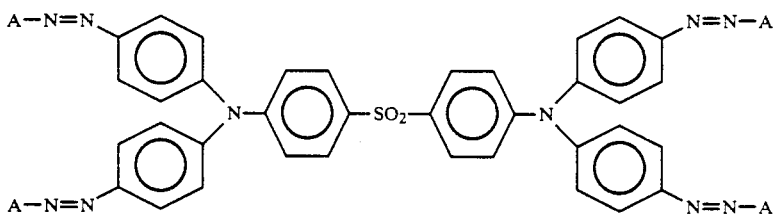 |
| 4-10 | 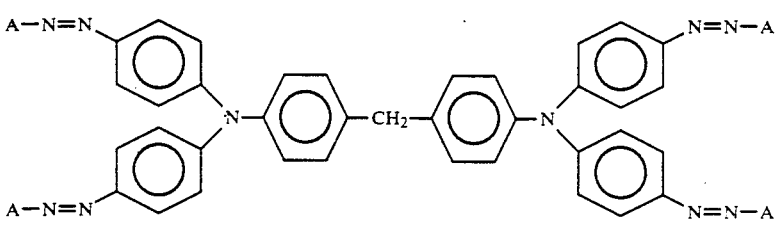 |

TABLE 1-continued
| Compound Group No. | |
|---|---|
| 4-11 | 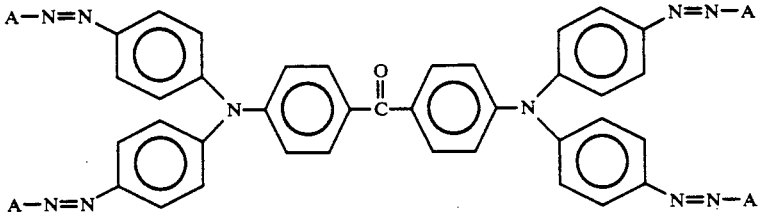 |
| 4-12 | 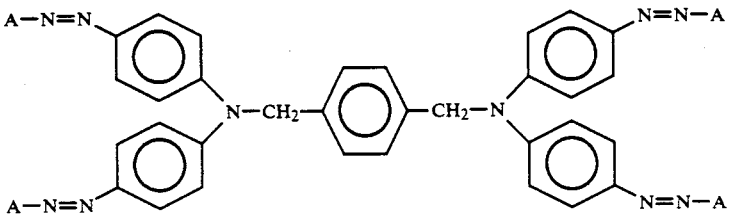 |
| 4-13 | 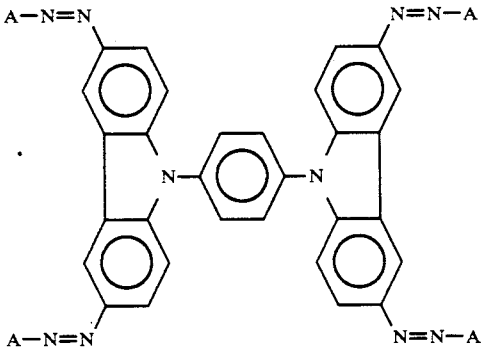 |
| 4-14 | 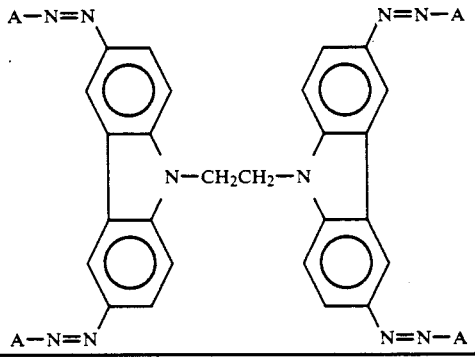 |
TABLE 2
| A No. | |
|---|---|
| A-1 | 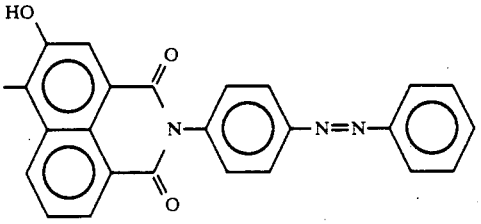 |

TABLE 2-continued
| A No. | |
|---|---|
| A-2 | 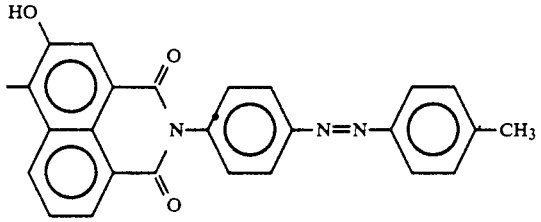 |
| A-3 | 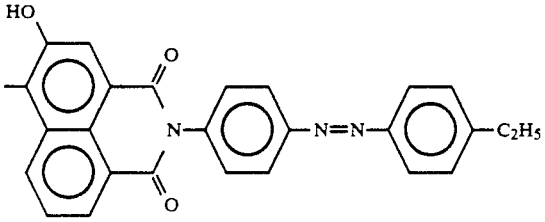 |
| A-4 | 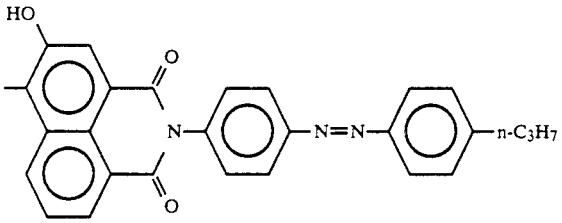 |
| A-5 | 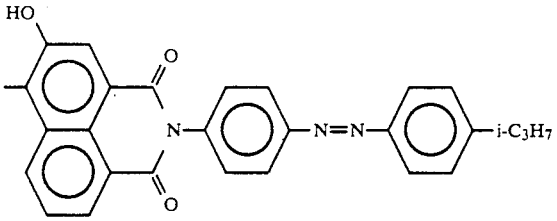 |
| A-6 | 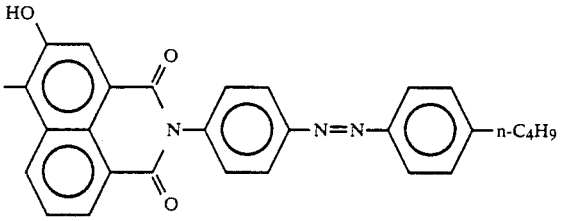 |
| A-7 | 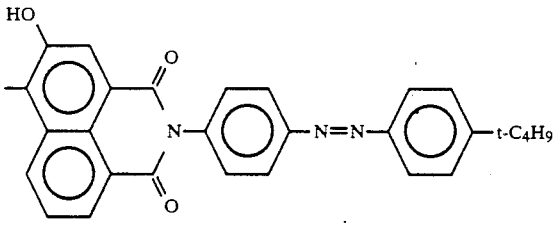 |
| A-8 | 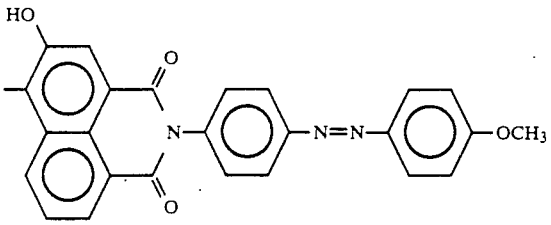 |

TABLE 2-continued
| A No. | |
|---|---|
| A-9 | 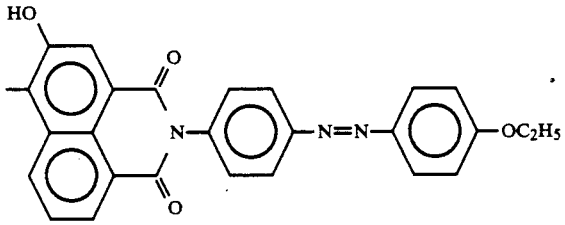 |
| A-10 | 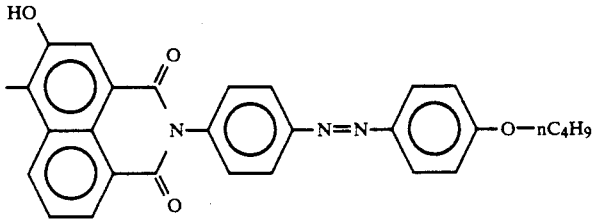 |
| A-11 | 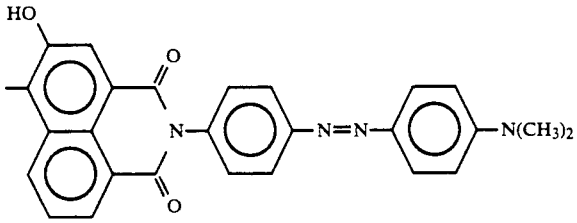 |
| A-12 | 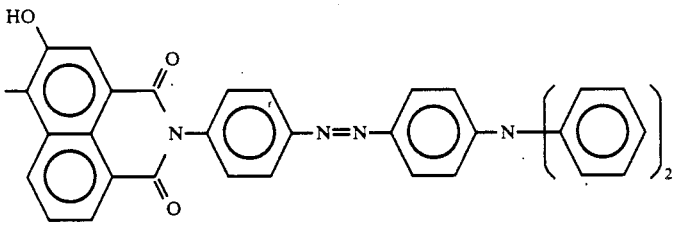 |
| A-13 | 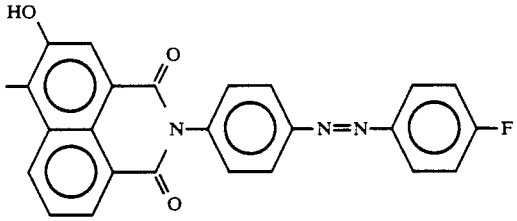 |
| A-14 | 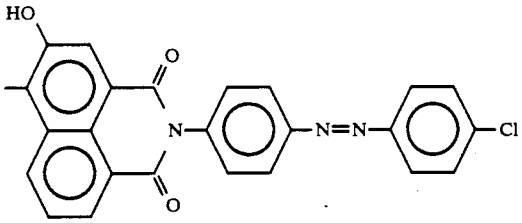 |
| A-15 | 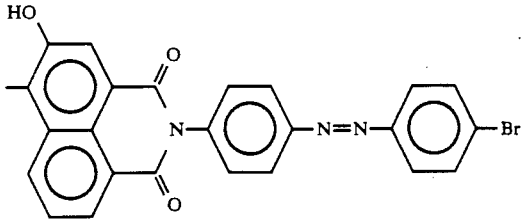 |

TABLE 2-continued
| A No. | |
|---|---|
| A-16 | 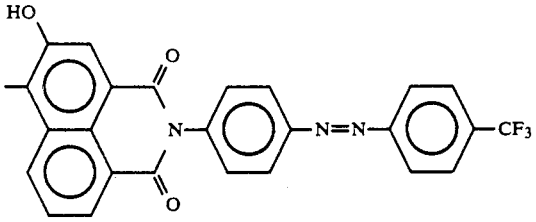 |
| A-17 | 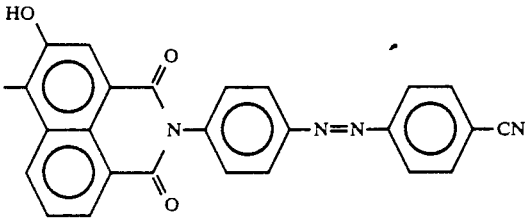 |
| A-18 | 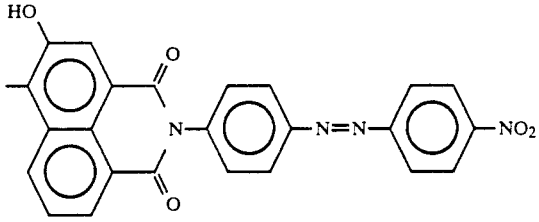 |
| A-19 | 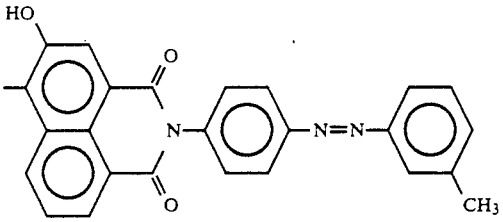 |
| A-20 | 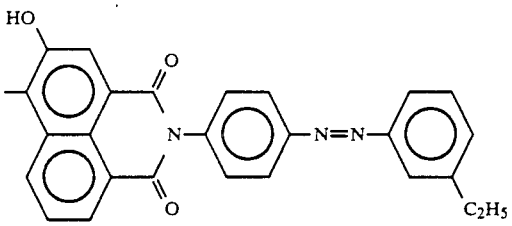 |
| A-21 | 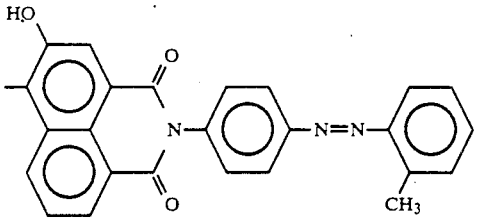 |
| A-22 | 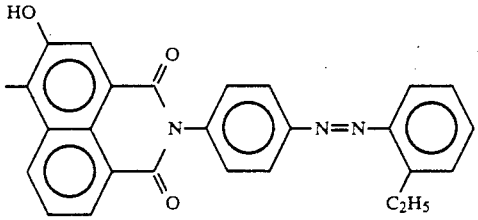 |

TABLE 2-continued
| A No. | |
|---|---|
| A-23 | 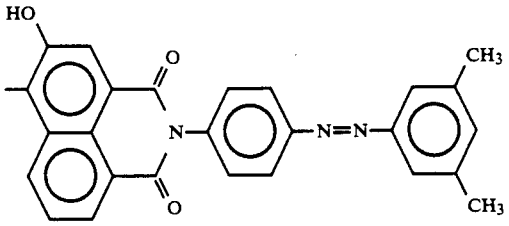 |
| A-24 | 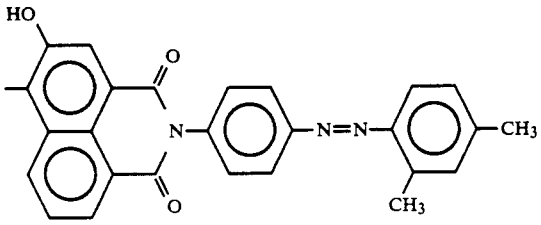 |
| A-25 | 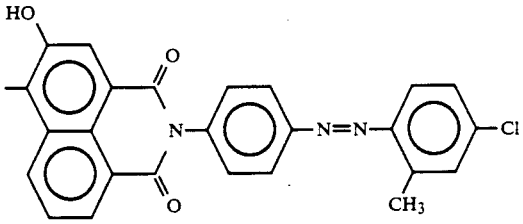 |
| A-26 | 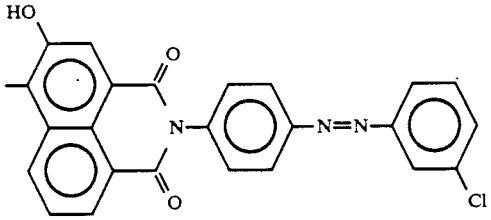 |
| A-27 | 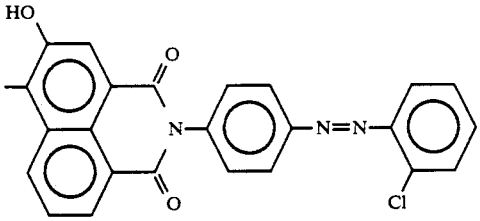 |
| A-28 | 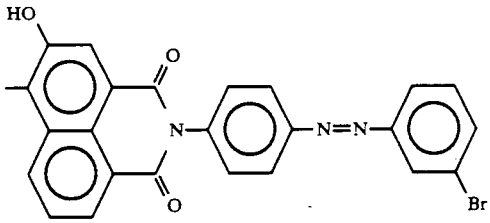 |
| A-29 | 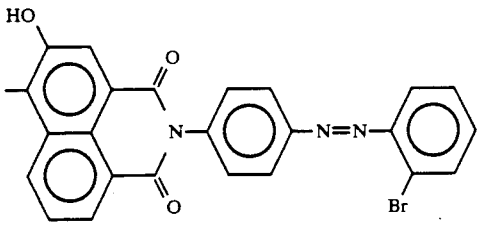 |

TABLE 2-continued
| A No. | |
|---|---|
| A-30 | 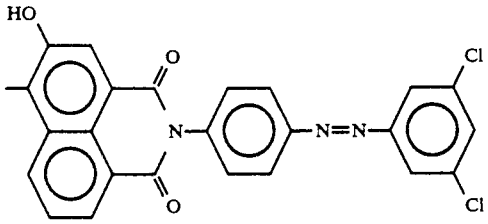 |
| A-31 | 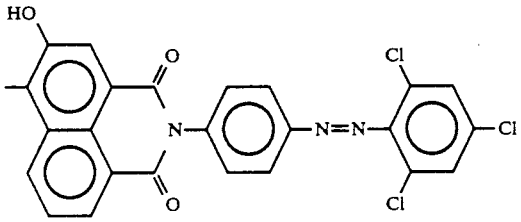 |
| A-32 | 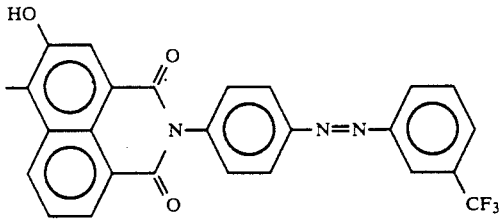 |
| A-33 | 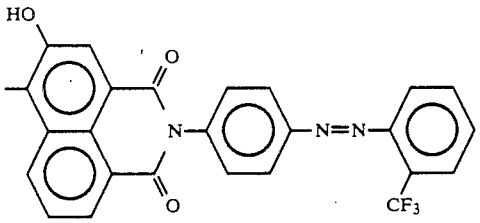 |
| A-34 | 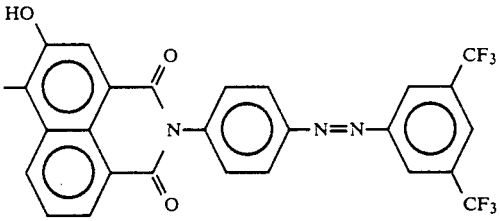 |
| A-35 | 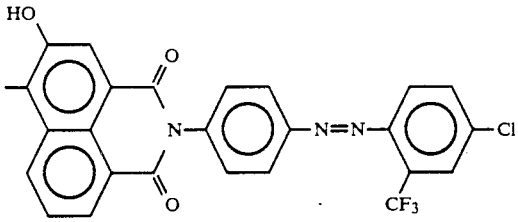 |
| A-36 | 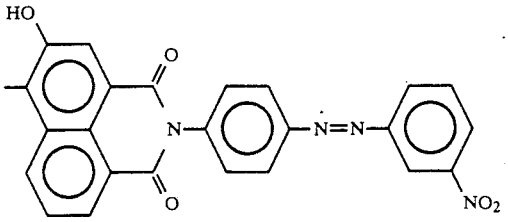 |

TABLE 2-continued
| A No. | |
|---|---|
| A-37 | 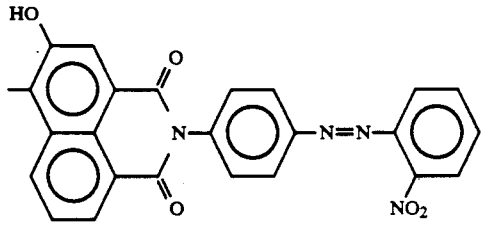 |
| A-38 | 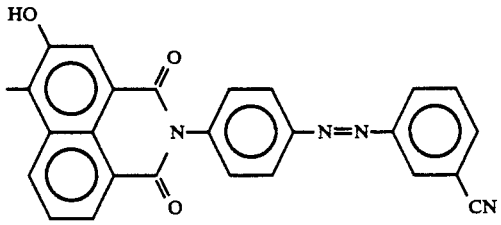 |
| A-39 | 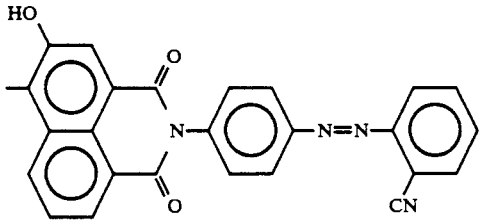 |
| A-40 | 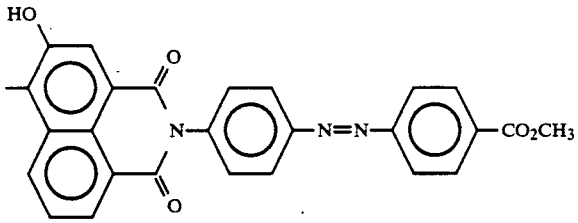 |
| A-41 | 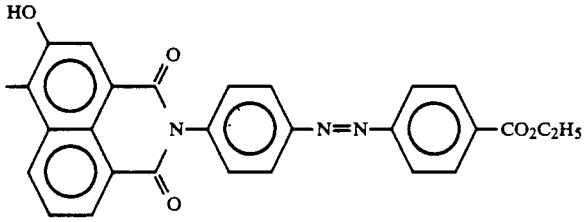 |
| A-42 | 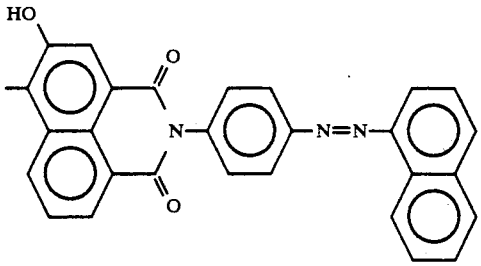 |
| A-43 | 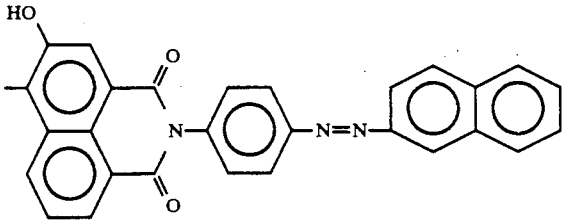 |

TABLE 2-continued
| A No. | |
|---|---|
| A-44 | 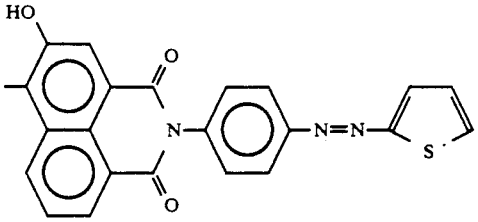 |
| A-45 | 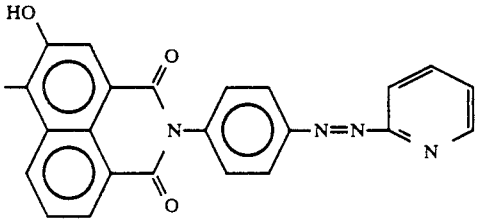 |
| A-46 | 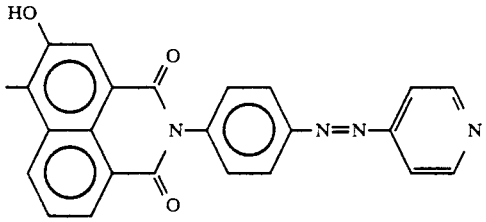 |
| A-47 | 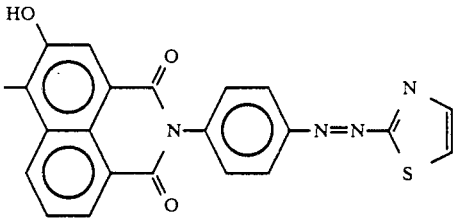 |
| A-48 | 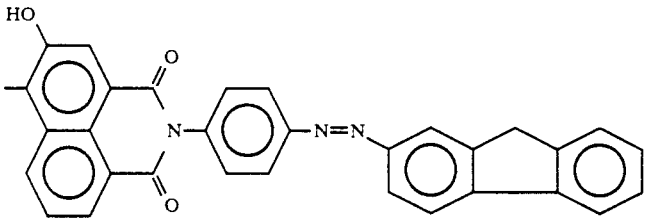 |
| A-49 | 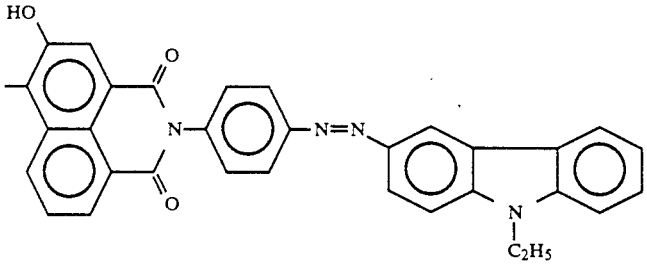 |
| A-50 | 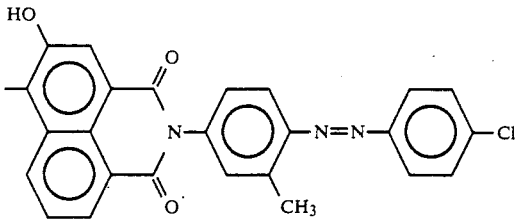 |

TABLE 2-continued
| A No. | |
|---|---|
| A-51 | 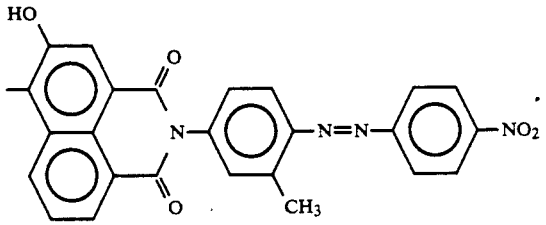 |
| A-52 | 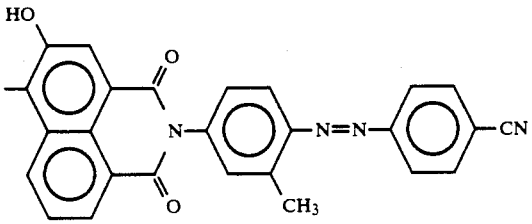 |
| A-53 | 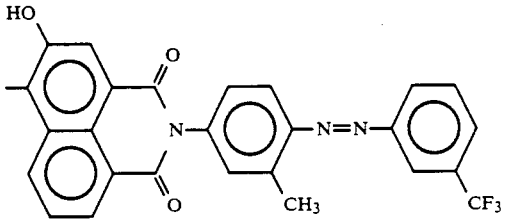 |
| A-54 | 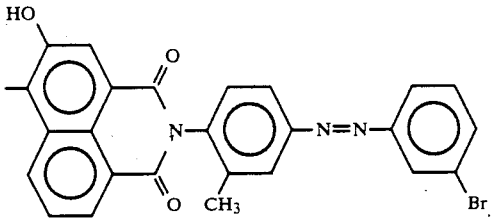 |
| A-55 | 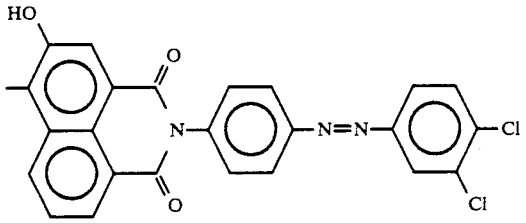 |
| A-56 | 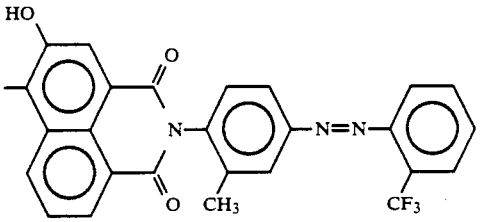 |
| A-57 | 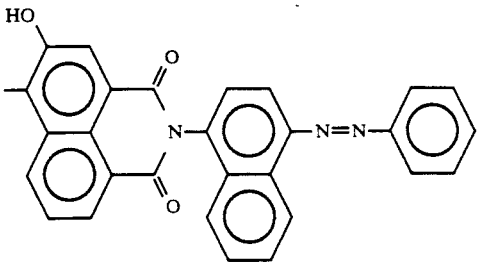 |

TABLE 2-continued
| A No. | |
|---|---|
| A-58 | 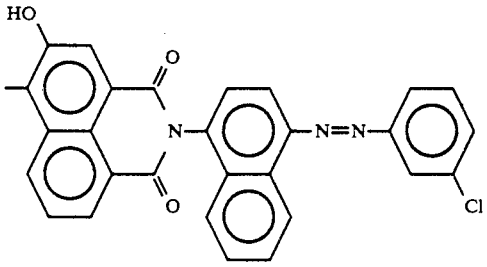 |
| A-59 | 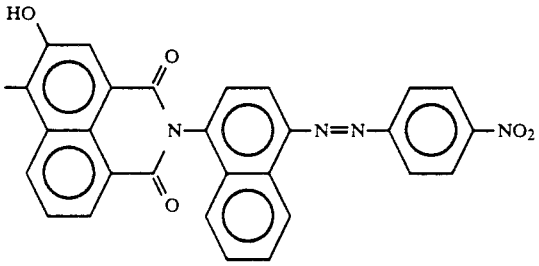 |
| A-60 | 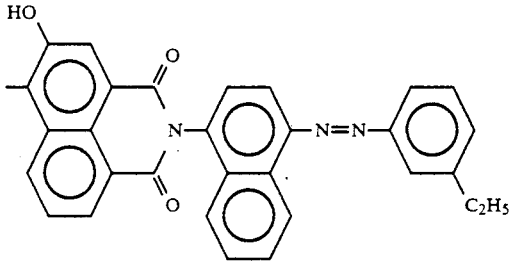 |
| A-61 | 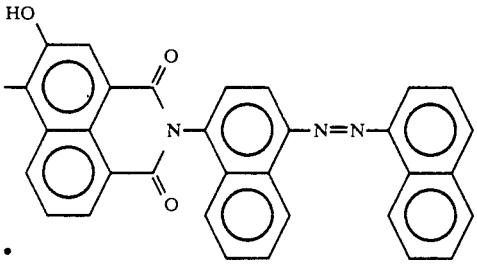 |
| A-62 | 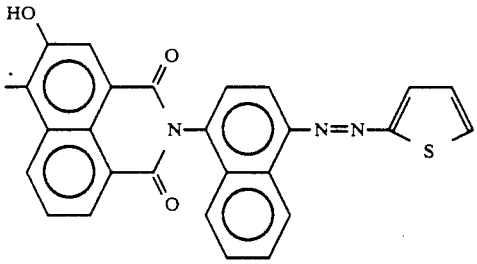 |
| A-63 | 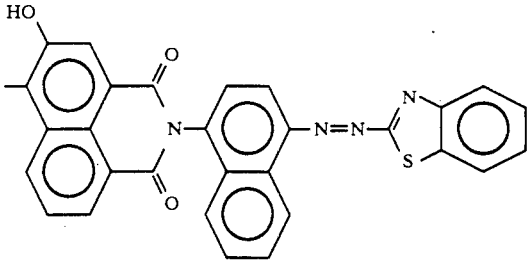 |

TABLE 2-continued
| A No. | |
|---|---|
| A-64 | 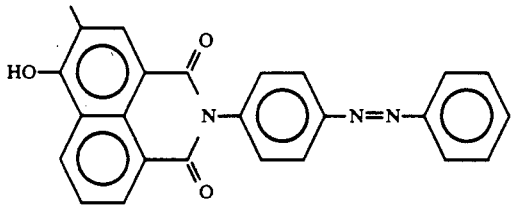 |
| A-65 | 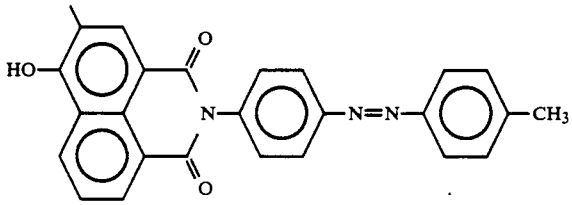 |
| A-66 | 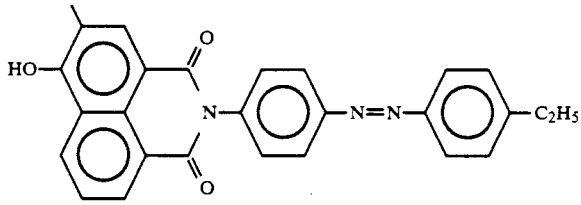 |
| A-67 | 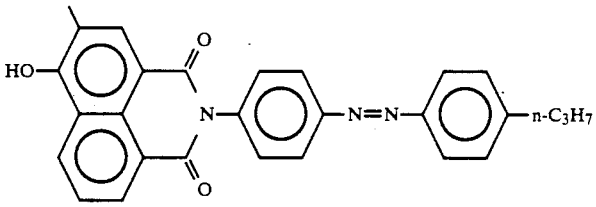 |
| A-68 | 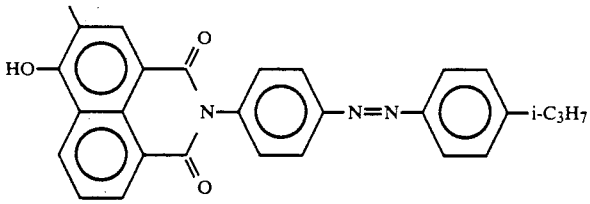 |
| A-69 | 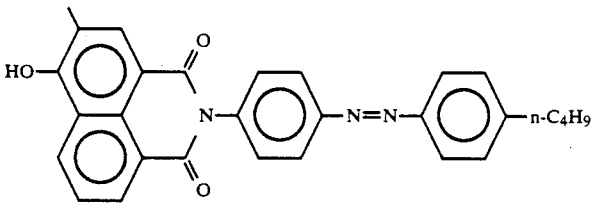 |
| A-70 | 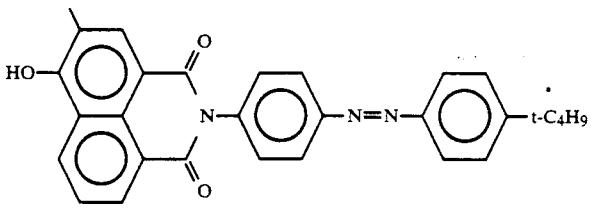 |

TABLE 2-continued
| A No. | |
|---|---|
| A-71 | 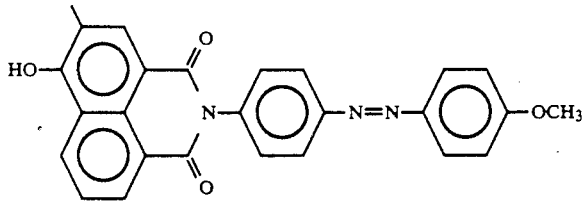 |
| A-72 | 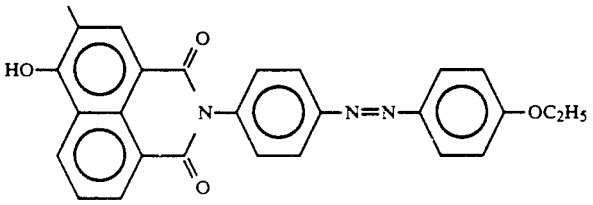 |
| A-73 | 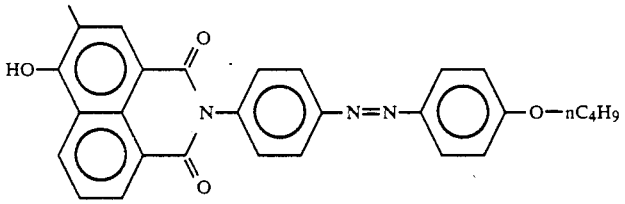 |
| A-74 | 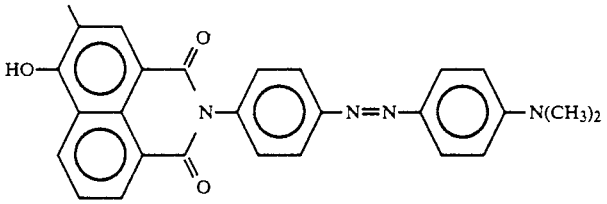 |
| A-75 | 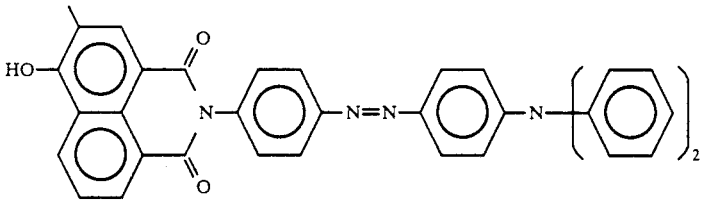 |
| A-76 | 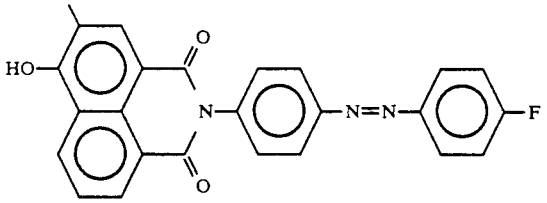 |
| A-77 | 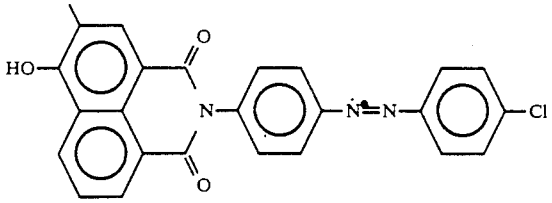 |

TABLE 2-continued
| A No. | |
|---|---|
| A-78 | 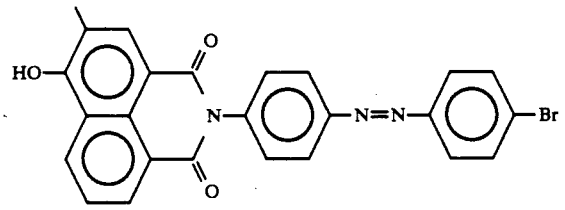 |
| A-79 | 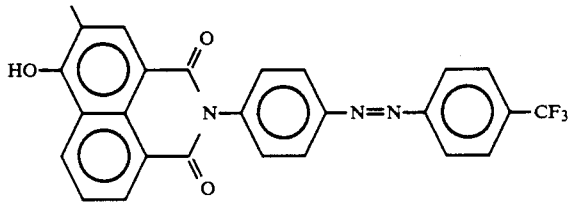 |
| A-80 | 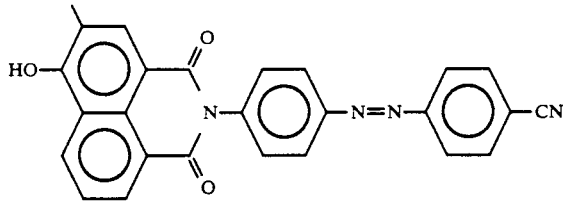 |
| A-81 | 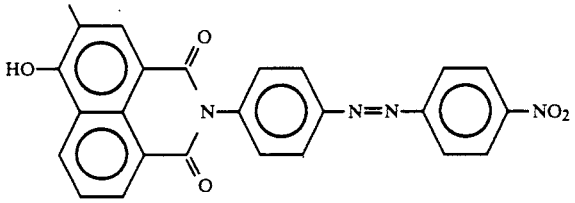 |
| A-82 | 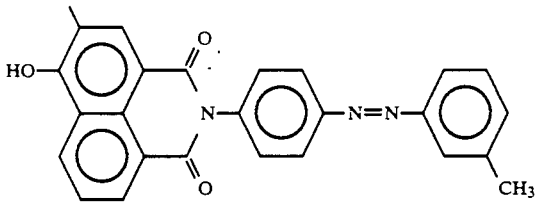 |
| A-83 | 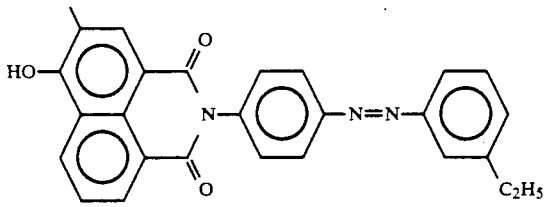 |
| A-84 | 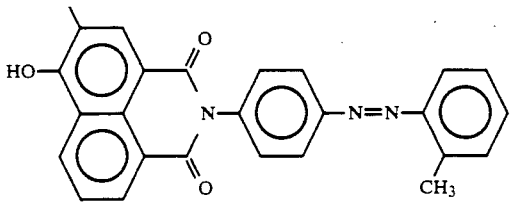 |

TABLE 2-continued
| A No. | |
|---|---|
| A-85 | 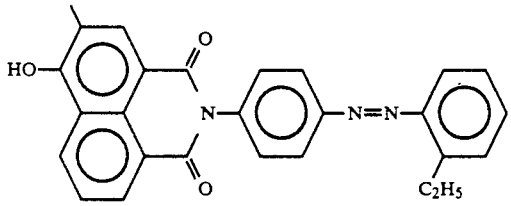 |
| A-86 | 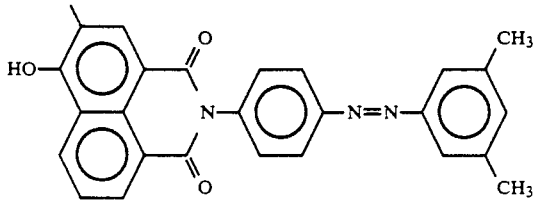 |
| A-87 | 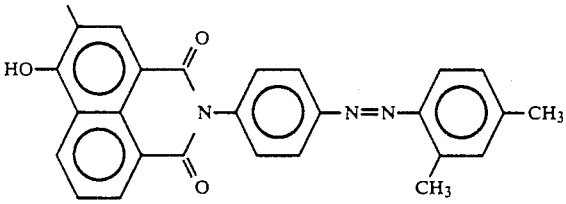 |
| A-88 | 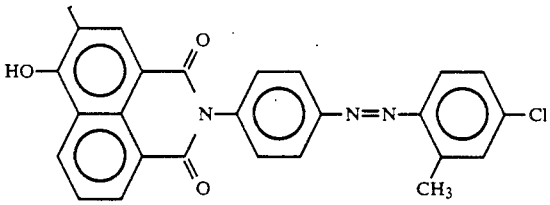 |
| A-89 | 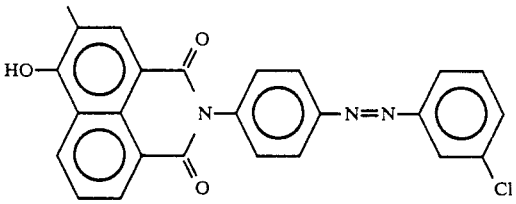 |
| A-90 | 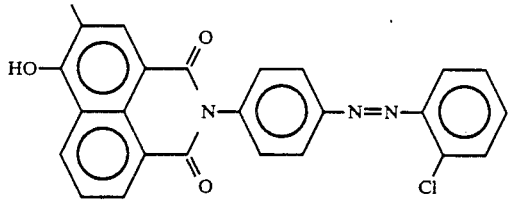 |
| A-91 | 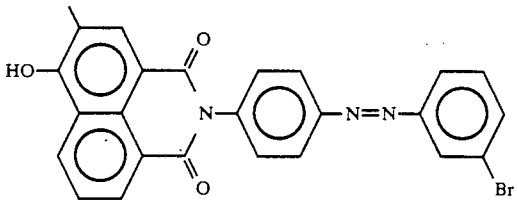 |

TABLE 2-continued
| A No. | |
|---|---|
| A-92 | 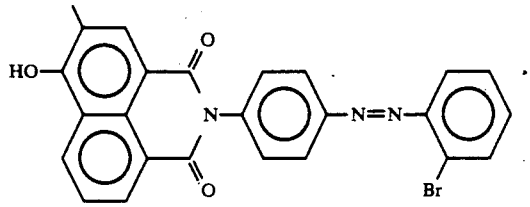 |
| A-93 | 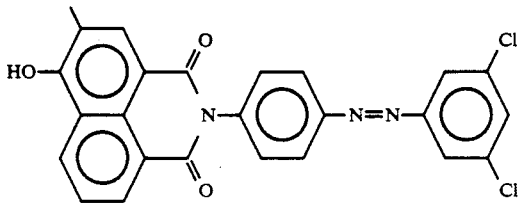 |
| A-94 | 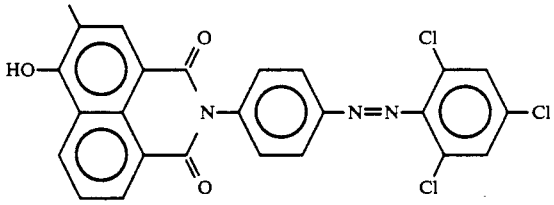 |
| A-95 | 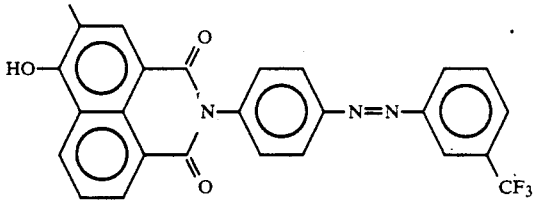 |
| A-96 | 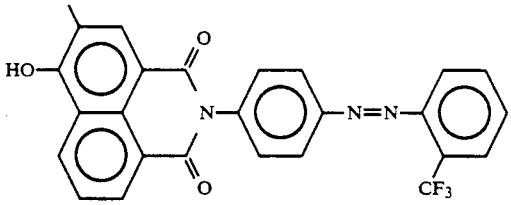 |
| A-97 | 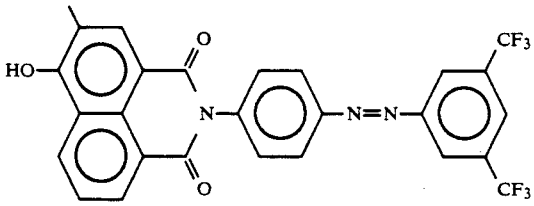 |
| A-98 | 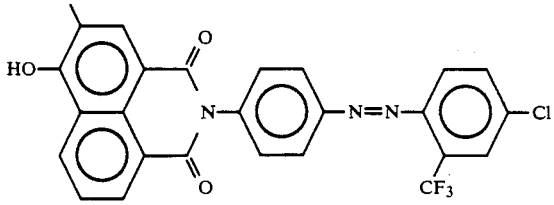 |

TABLE 2-continued
| A No. | |
|---|---|
| A-99 | 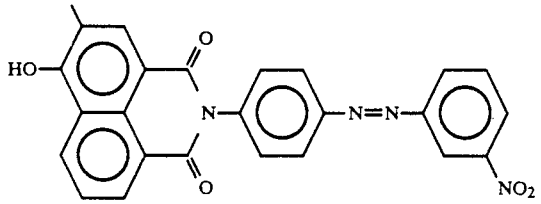 |
| A-100 | 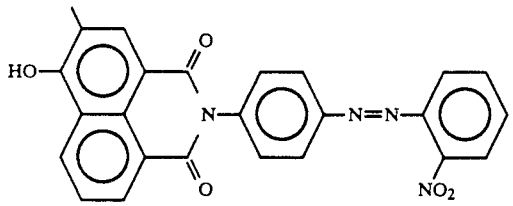 |
| A-101 | 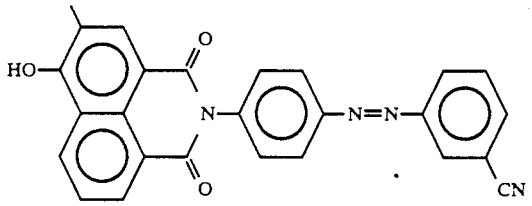 |
| A-102 | 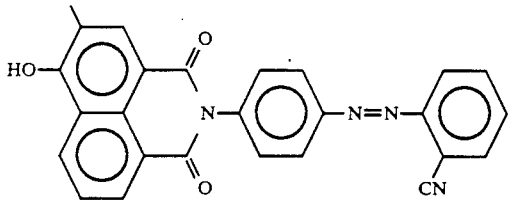 |
| A-103 | 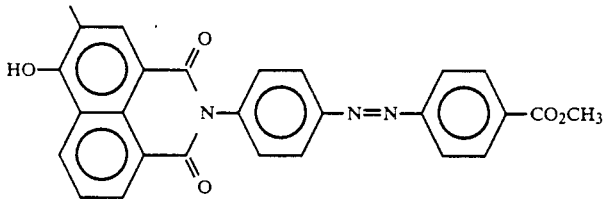 |
| A-104 | 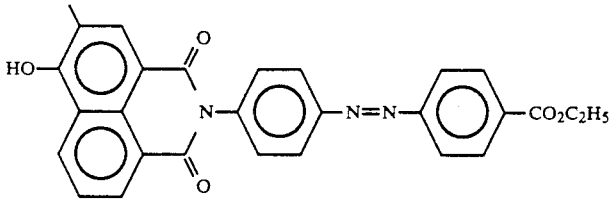 |
| A-105 | 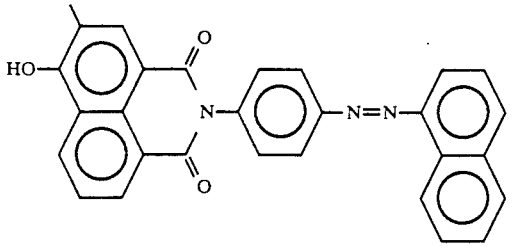 |

TABLE 2-continued
| A No. | |
|---|---|
| A-106 | 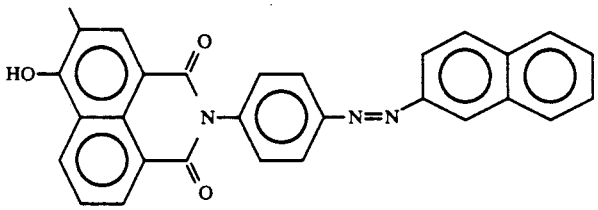 |
| A-107 | 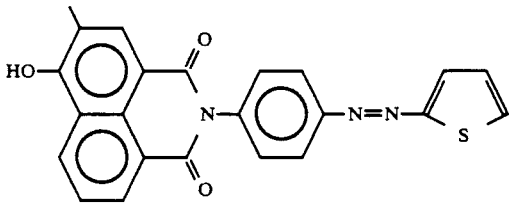 |
| A-108 | 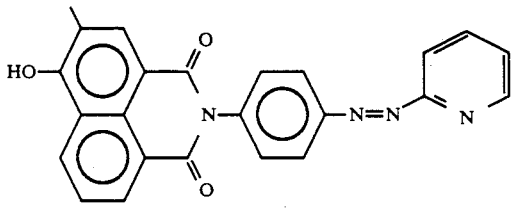 |
| A-109 | 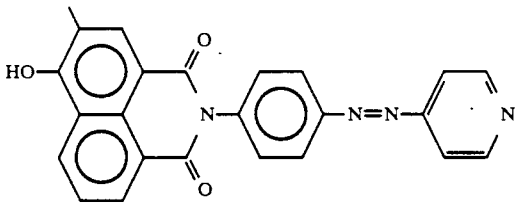 |
| A-110 | 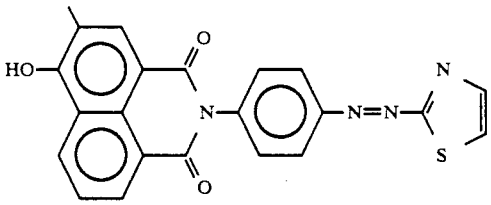 |
| A-111 | 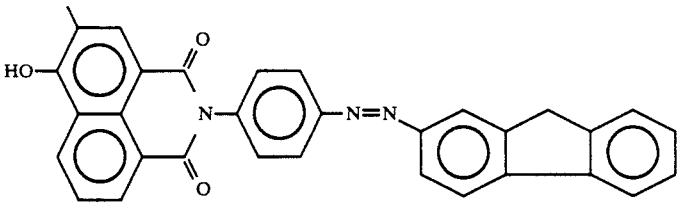 |
| A-112 | 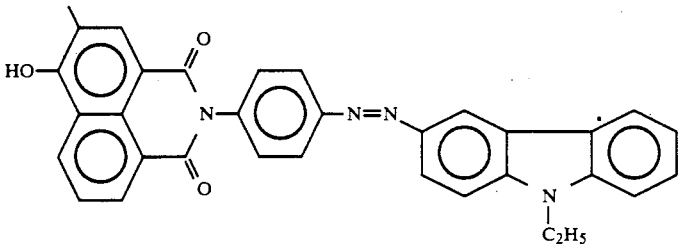 |

TABLE 2-continued
| A No. | |
|---|---|
| A-113 | 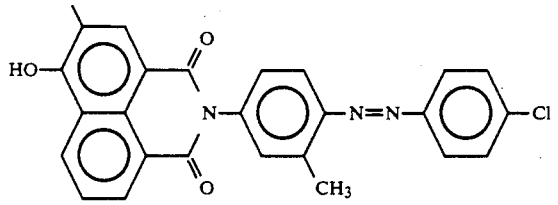 |
| A-114 | 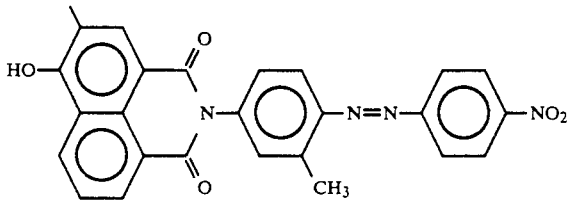 |
| A-115 | 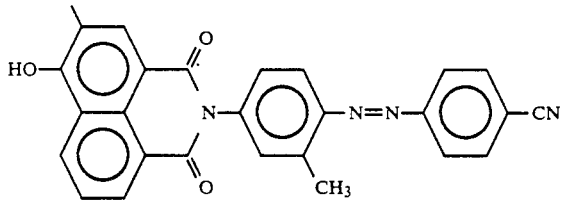 |
| A-116 | 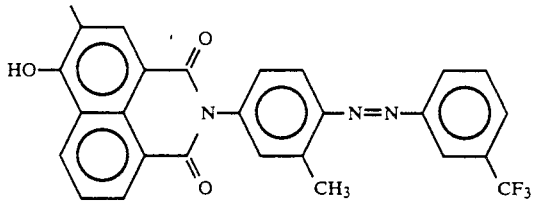 |
| A-117 | 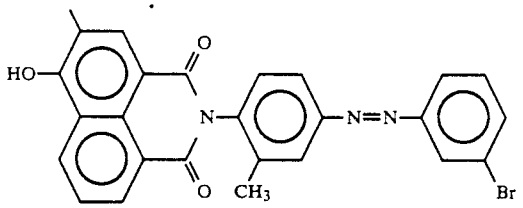 |
| A-118 | 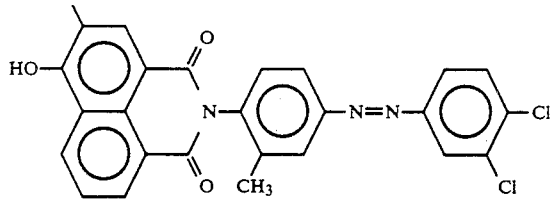 |
| A-119 | 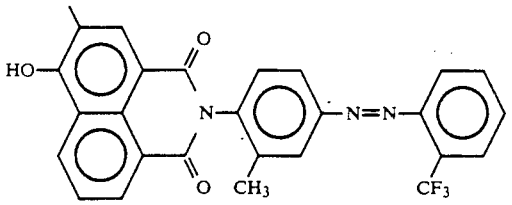 |

TABLE 2-continued
| A No. | |
|---|---|
| A-120 | 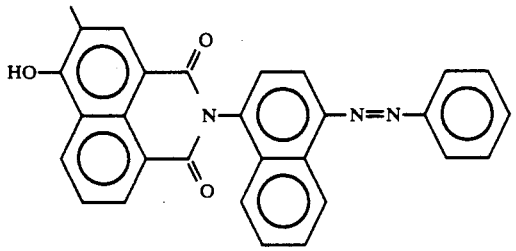 |
| A-121 | 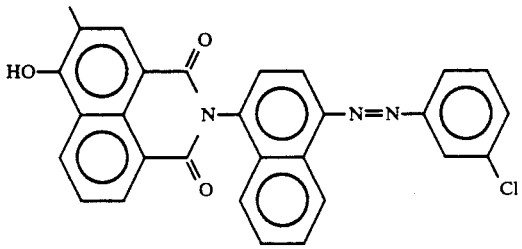 |
| A-122 | 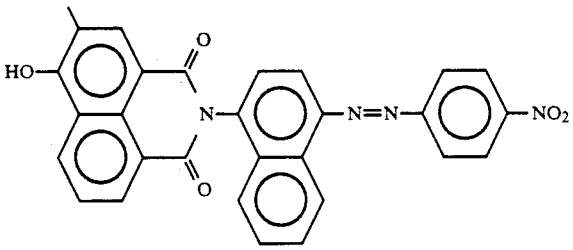 |
| A-123 | 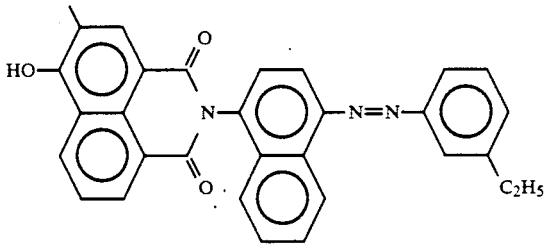 |
| A-124 | 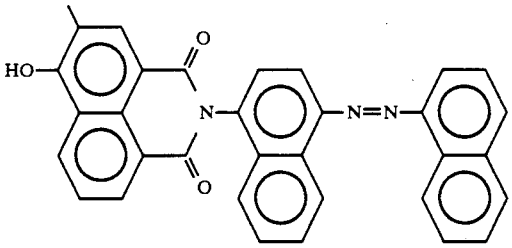 |
| A-125 | 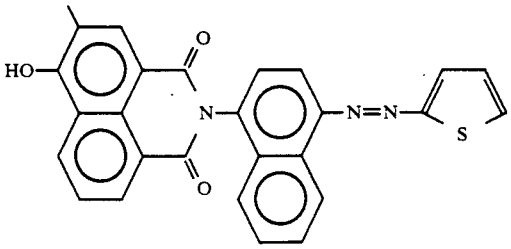 |

TABLE 2-continued

| A No. | |
|---|---|
| A-126 | 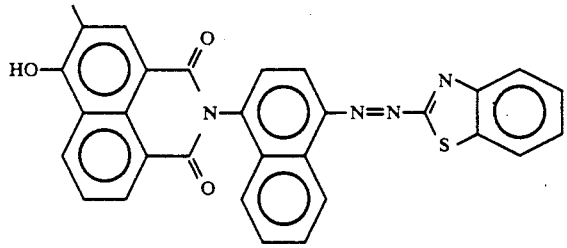 |

The synthesis of the novel azo compound present invention can be easily accomplished by the following method. Specifically, a coupler component represented by the general formula (11) is allowed to undergo coupling with a diazonium, tetrazonium, hexazonium or octazonium salt derived from an aromatic mono-, di- or tetraamine represented by the general formula:

$$Ar^1(NH_2)_n$$

wherein $Ar^1$ represents an aromatic hydrocarbon or heterocyclic group which may be connected thereto via a connecting group; and n represents an integer 1, 2, 3 or 4, in the presence of an alkali in a solvent such as N,N-dimethylformamide and dimethylsulfoxide.

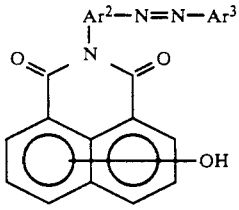

(11)

wherein $Ar^2$ and $Ar^3$ are as defined in the general formula (1).

The coupler represented by the general formula (11) can be obtained by heating anhydrous hydroxy-1,8-naphthalic acid (12) and an amine (13) without any solvent or in an inert solvent such as acetic acid or optionally by allowing these materials to undergo reaction in the presence of a catalyst such as p-toluene-sulfonic acid and hydrochloric acid, in accordance with the following reaction formula (1):

Reaction Formula (1)

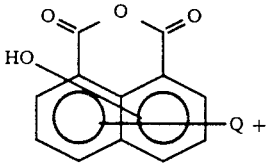

(12)

-continued

Reaction Formula (1)

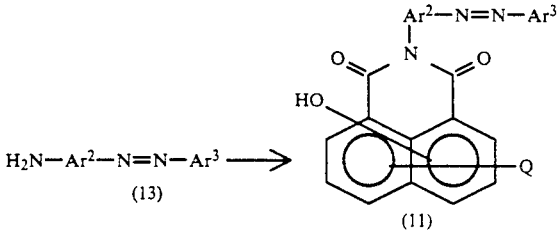

(13) (11)

wherein $Ar^2$ and $Ar^3$ are as defined in the general formula (1).

Among the azo compounds of the present invention, bisazo, trisazo and tetrakisazo compounds may contain other coupler components so long as they contain one or more coupler components represented by the general formula (11) in the same molecule. The synthesis of these azo compounds can be accomplished as follows:

Specifically, an amino compound represented by the general formula:

$$(CH_3CONH)_mAr^1(NH_2)_l$$

wherein $Ar^1$ represents an aromatic hydrocarbon or heterocyclic group which may be connected thereto via a connecting group; and m each represents an integer 1, 2 or 3, with the proviso that the sum of l and m is 2, 3 or 4, is converted to a diazo compound. The diazo compound is then allowed to undergo coupling with a coupler represented by the general formula (11). The material is allowed to undergo hydrolysis with a mineral acid such as hydrochloric acid to obtain a compound represented by the general formula:

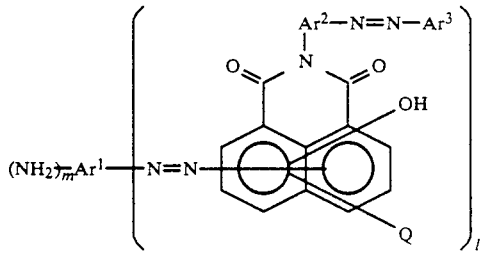

The compound thus obtained is converted to a diazo compound which is allowed to undergo coupling with another coupler to obtain the desired azo compound. Alternatively, a coupler component represented by the general formula (11) is allowed to undergo coupling with a diazonium, tetrazonium, hexazonium or octazonium salt derived from an aromatic mono-, di- or tetraamine represented by the general formula:

$Ar^1(NH_2)_n$ wherein $Ar^1$ represents an aromatic hydrocarbon or heterocyclic group which may be connected thereto via a connecting group; and n represents an integer 1, 2, 3 or 4, in the presence of an alkali in a solution containing another coupler.

SYNTHESIS EXAMPLE 1

Synthesis of A-1 shown in Table 2

5 g (23.4 mmol) of anhydrous 3-hydroxy-1,8-naphthalic acid and 6.9 g (35 mmol) of phenylazoaniline were dissolved in 30 ml of acetic acid. The solution was then heated under reflux with stirring over 8 hours. The reaction product was then cooled to room temperature, filtered off, and washed with acetic acid and with methanol. The material was then recrystallized from methanol to obtain 5.3 g of Coupler A-1. (Yield: 58%)

Elementary analysis:

Calculated % for C24H15N403 C73.27, H3.84, N10.68.

Found %:C73.13, H3.72, N10.91

SYNTHESIS EXAMPLE 2

Synthesis of a tetrakisazo compound represented by Compound Group No. 4-5 in Table 1 wherein A is No. A-1

0.672 (0.001 mmol) of a tetraamino compound represented by the structural formula (6) was added to a dilute hydrochloric acid prepared from 2.5 ml of concentrated hydrochloric acid and 3 ml of water. The mixture was stirred on a water bath at a temperature of ° C over about 30 minutes. The mixture was cooled to a temperature of 0° C. A solution of 0.3 g of sodium nitride in 3 ml of water was added dropwise to the mixture at a temperature of 0° C. The mixture was further stirred at the same temperature over 1 hour. A small amount of unreacted matters were then filtered off. The filtrate was then added dropwise to a solution consisting of 1.57 g (0.004 mol) of the coupler prepared in Synthesis Example 1, 1 g of sodium acetate, 3 ml of water and 100 ml of DMF with stirring while cooled with ice. The mixture was then stirred at room temperature over 2 hours. The resulting crystal was then filtered off, and washed with water and then with acetone. These crystallization, filtration and washing processes were repeated so that the product was purified. As a result, 1.39 g of a black powder of the desired tetrakisazo compound (1) was obtained. (Yield: 62%; decomposition temperature: 300° C.)

Elementary analysis:

Calculated % for $C_{134}H_{90}N_{26012}$ C71.33, H4.02, N16.14.

Found %:C71.20, H4.21, N16.01.

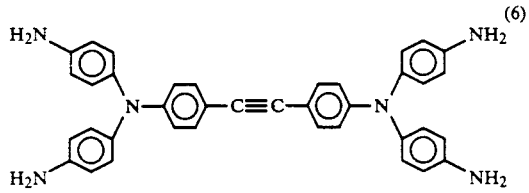

(6)

The electrophotographic photoreceptor of the present invention comprises an electrophotographic light-sensitive layer containing one or two azo compounds having a structure in which an organic residue represented by the general formula (1) is connected to an aromatic hydrocarbon or heterocyclic group optionally via a connecting group. Various forms of electrophotographic photoreceptors have been known. The electrophotographic photoreceptor of the present invention may be in any of these forms but normally has an electrophotographic photoreceptor structure of any of the following types (I), (II) and (III):

(I) Structure comprising on an electrically conductive support an electrophotographic light-sensitive layer with an azo compound dispersed in a binder or charge-transporting medium;

(II) Structure comprising on an electrically conductive support a charge-generating layer containing an azo compound as a main active component and a charge-transporting layer provided thereon; and (III) Structure comprising on an electrically conductive support a charge-transporting layer and a charge-generating layer containing an azo compound as a main active component provided thereon.

The azo compound of the present invention has an effect of producing a charge carrier at an extremely high efficiency upon absorption of light. The charge carrier thus produced is transported by a charge-transporting compound.

The preparation of an electrophotographic photoreceptor of Type (I) can be accomplished by dispersing finely divided grains of an azo compound in a binder solution or a solution containing a charge-transporting compound and a binder solution, coating the dispersion on an electrically conductive support, and then drying the coated material. The thickness of the electrophotographic light-sensitive layer thus prepared may be in the range of 3 to 30 μm, preferably 5 to 20 μm.

The preparation of an electrophotographic photoreceptor of Type (II) can be accomplished by vacuum-evaporating a tetrakisazo compound on an electrically conductive support to form a charge-generating layer thereon or by dispersing finely divided grains of an azo compound in a proper solvent containing a binder resin, coating the dispersion on a support, drying the coated material to form a charge-generating layer thereon, and then optionally finishing the surface of the layer by a proper process such as buffing or otherwise adjusting the thickness of the film, coating a solution containing a charge-transporting substance and a binder resin thereon, and drying the coated material. The thickness of the charge-generating layer thus prepared may be in the range of 0.01 to 4 μm, preferably 0.1 to 2 μm. The thickness of the charge-transporting layer may be in the range of 3 to 30 μm, 5 to 20 μm.

The preparation of an electrophotographic photoreceptor of Type (III) can be accomplished by reversing the order of lamination of the electrophotographic photoreceptor of Type (II).

The azo compound to be incorporated in the photoreceptor of Types (I), (II) and (III) is subjected to dispersion in a dispersion apparatus such as ball mill, sand mill and oscillating mill to an average grain diameter of 0.1 to 2 μm, preferably 0.3 to 2 μm before use.

If the amount of the azo compound to be incorporated in the electrophotographic photoreceptor of Type (I) is too small, the photoreceptor thus obtained exhibits a poor sensitivity. On the other hand, if the amount of the azo compound to be incorporated in the electrophotographic photoreceptor is too large, the photoreceptor thus obtained exhibits a poor chargeability and a poor film strength in the electrophotographic light-sensitive layer. The weight proportion of the azo compound in the electrophotographic light-sensitive layer, if a binder is incorporated therein, may be in the range of 0.01 to 2 times, preferably 0.05 to 1 time that of the binder. The weight proportion of the charge-transporting compound may be in the range of 0.1 to 2 times, preferably 0.3 to 1.5 times that of the binder. In the case of a charge-transporting compound which can be used as a binder itself, the amount of the azo compound to be incorporated is preferably in the range of 0.01 to 0.5 times that of the charge-transporting compound.

In the case where an azo compound-containing layer is coated as a charge-generating compound-containing layer in the preparation of an electrophotographic photoreceptor of Type (II) or (III), the amount of the azo compound to be incorporated is preferably in the range of 0.1 or more times that of the binder. If the value is less than this range, a sufficient sensitivity cannot be obtained. Such a azo compound can be also used in the absence of a binder. The weight proportion of the charge-transporting compound to be incorporated in the charge-transporting compound-containing layer may be in the range of 0.2 to 2 times, preferably 0.3 to 1.5 times that of the binder. In the which can be used as a binder itself is employed, such a compound can be used in the absence of any other binders.

Examples of an electrically conductive support to be incorporated in the present electrophotographic photoreceptor include plate of metal such as aluminum, copper and zinc, material comprising a sheet or film of plastic such as polyester with an electrically conductive material such as aluminum, indium oxide, tin oxide and copper iodide vacuum-evaporated or dispersion-coated thereon, and paper treated with an inorganic salt such as sodium chloride and calcium chloride or an organic quaternary ammonium salt.

If a binder is used, as such a binder there may be preferably used a hydrophobic high dielectricity electrical insulating film-forming high molecular polymer. Specific examples of such a high molecular polymer will be set forth below, but the present invention should not be construed as being limited thereto.

Polycarbonate, polyester, polyester carbonate, polysulfone, methacrylic resin, acrylic resin, polyvinyl chloride, polyvinylidene chloride, polystyrene, polyvinyl acetate, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin, styrene-maleic anhydride copolymer, phenoxy resin, polyvinylbutyral resin, and poly-N-vinylcarbazole.

These resin binders can be used singly or in admixture.

In the present photoreceptor, a plasticizer can be used in admixture with a resin binder.

Examples of such a plasticizer which can be used in the present invention include biphenyl, biphenyl chloride, o-terphenyl, p-terphenyl, dibutyl phthalate, dimethyl glycol phthalate, dioctyl phthalate, triphenylphosphoric acid, chlorinated paraffin, and dilauryl thiodipropionate.

In the preparation of the present electrophotographic photoreceptor, an additive such as sensitizer may be incorporated in the light-sensitive layer.

Examples of such a sensitizer include triallyl methane dye such as Brilliant Green, Victorian Blue B, Methyl Violet, Crystal Violet and Acid Violet 6B, xanthene dye such as Rhodamine B, Rhodamine 6G, Rhodamine G Extra, Eosine S, Erythrosine, Rose Bengal and Fluoresceine, thiazine dye such as Methylene Blue, astrazone dye such as C. I. Basic, Violet 7 (e.g., C. I. 48020), cyanine dye, and pyrilium dye such as 2,6-diphenyl-4-(N,N-dimethylaminophenyl)thiapyrilium perchlorate and benzopyrilium salt (as described in JP-B-48-25658).

In order to improve the surface characteristics of the electrophotographic photoreceptor, a silicone oil, fluorine surface active agent or the like may be used.

Charge-transporting substances to be incorporated in the charge-transporting layer of the present invention can be classified into two kinds of compounds: compounds which transport electrons and compounds which transport positive holes. The electrophotographic photoreceptor of the present invention can comprise either of these two types of compounds.

As such a compound which transports electrons there can be used a compound containing an electron attractive group. Examples of such a compound include 2,4,7-trinitro-9-fluorenone, 2,4,5,7-tetranitro-9-fluorenone, 9-dicyanomethylene-2,4,7-trinitrofluorenone, 9-dicyanomethylene-2,4,5,7-tetranitrofluorenone, tetranitrocarbazole, chloranil, 2,3-dichloro-5,6-dicyanobenzoquinone, 2, 4,7 -tri nitro-9,10-phenanthrenequinone, tetrachlorophthalic anhydride, tetracyanoethylene, and tetracyanoquinodimethane.

As such a compound which transports positive holes there can be used a compound containing an electron-donating group.

Examples of such a compound having a high molecular weight include:

(a) Polyvinyl carbazoles and derivatives thereof as described in JP-B-34-10966;
(b) Vinyl polymers as described in JP-B-43-18674 and JP-B-43-19192 such as polyvinyl pyrene, polyvinyl anthracene, poly-2-vinyl-4-(4'-dimethylaminophenyl)-5phenyloxazole and poly-3-vinyl-N-ethylcarbazole;
(c) Polymers as described in JP-B-43-19193 such as copolymers of styrene with polyacenaphthylene, polyindene or acenaphthylene;
(d) Condensed resins as described in JP-B-56-13940 such as pyrene-formaldehyde resin, bromopyrene-formaldehyde resin and ethylcarbazole-formaldehyde resin; and
(e) Various triphenylmethane polymers as described in JP-A-56-90883 and JP-A-56-161550.

Examples of such a compound having a low molecular weight include:

(f) Triazole derivatives as described in U.S. Pat. 3,112,197;
(g) Oxadiazole derivatives as described in U.S. Pat. No. 3,189,447;
(h) Imidazole derivatives as described in JP-B-37-16096;
(i) Polyarylalkane derivatives as described in U.S. Pat. Nos. 3,615,402, 3,820,989 and 3,542,544, JP-B-45-555 and JP-B-51-10983, and JP-A-51-93224, JP-A-55-108667, JP-A-55-156953, and JP-A-56-36656;

(j) Pyrazoline derivatives and pyrazolone derivatives as described in U.S. Pat. Nos. 3,180,729 and 4,278,746, and JP-A-55-88064, JP-A-55-88065, JP-A-49-105537, JP-A-55-51086, JP-A-56-80051, JP-A-56-88141, JP-A-57-45545, JP-A-54-112637 and JP-A-55-74546;

(k) Phenylenediamine derivatives as described in U.S. Pat. No. 3,615,404, JP-B-51-10105, JP-B-46-3712 and JP-B-47-28336, and JP-A-54-83435, JP-A-54-110836 and JP-A-54-119925;

(l) Arylamine derivatives as described in U.S. Pat. Nos. 3,567,450, 3,180,703, 3,240,597, 3,658,520, 4,232,103, 4,175,961 and 4,012,376, West German Patent (DAS) 1,110,518, JP-B-49-35702 and JP-B-39-27577, and JP-A-55-144250, JP-A-56-119132, and JP-A-56-22437;

(m) Amino-substituted chalcone derivatives as described in U.S. Pat. No. 3,526,501;

(n) N,N-bicarbazyl derivatives as described in U.S. Pat. 3,542,546;

(o) Oxazole derivatives as described in U.S. Pat. No. 3,257,203;

(p) Styrylanthracene derivatives as described in JP-A-56-46234;

(q) Fluorenone derivatives as described in JP-A-54-110837;

(r) Hydrazone derivatives as described in U.S. Pat. No. 3,717,462, and JP-A-54-59143 (U.S. Pat. No. 4,150,987), JP-A-55-52063, JP-A-55-52064, JP-A-55-46760, JP-A-55-85495, JP-A-57-11350, JP-A-57-148749 and JP-A-57-104144;

(s) Benzidine derivatives as described in U.S. Pat. Nos. 4,047,948, 4,047,949, 4,265,990, 4,273,846, 4,299,897 and 4,306,008; and (t) Stilbene derivatives as described in JP-A-58-190953, JP-A-59-95540, JP-A-59-97148, JP-A-59-195658 and JP-A-62-36674.

In the present invention, the charge-transporting compounds should not be construed as being limited to those belonging to the compound groups (a) to (t). All charge-transporting compounds which have heretofore been known can be used.

In the preparation of the present electrophotographic photoreceptor, a charge-transporting compound may be incorporated in the charge-generating layer.

In the present electrophotographic photoreceptor, an adhesive layer or barrier layer can be optionally provided between the electrically conductive support and the light-sensitive layer. As examples of materials to be incorporated in these layers there can be used polymers which can be as the above described binder. Other examples of materials to be incorporated in these layers include gelatin, casein, polyvinyl alcohol, ethyl cellulose, carboxymethyl cellulose, vinylidene chloride polymer latexes as described in JP-A-59-84247, styrene-butadiene polymer latexes as described in JP-A-59-114544, and aluminum oxide. The thickness of these layers is preferably in the range of 1 μm or less.

The electrophotographic photoreceptor thus obtained can be treated properly so as to protect itself from an interfering band produced when an interfering light such as laser is used for exposure. There have been proposed many such treatment methods. For example, JP-A-60-186850 proposes the provision of an undercoating layer having a light scattering surface. JP-A-60-184258 proposes the provision of a titanium black-containing undercoating layer. JP-A-58-82249 proposes the absorption of a major part of light to be used in a charge-generating layer. JP-A-61-18963 proposes that a charge-transporting layer should have a microphase separating structure. JP-A-60-86550 proposes the incorporation of a substance which absorbs or scatters an interfering light in a photoconductive layer. JP-A-63-106757 proposes the provision of an indentation having a depth of one-fourth of the wavelength of an interfering light on the surface of a light-sensitive material. JP-A-62-172371 and JP-A-62-174771 proposes the provision of a light-scattering layer or light-absorbing layer on the back surface of a transparent support.

The present electrophotographic photoreceptor has been described in detail. The present electrophotographic photoreceptor generally exhibits a high sensitivity and a small change in the electrophotographic properties after repeated use.

The present electrophotographic photoreceptor can be widely used in electrophotographic copying machines as well as in the field of light-sensitive materials for printers using laser, CRT, LED or the like as light source.

A photoconductive composition containing the present azo compound can be used as a photoconductive layer in the pickup tube for video camera or as a photoconductive layer having a light-receiving layer (photoconductive layer) in a solid-state imaging device provided on the entire surface of one-dimensionally or two-dimensionally arranged semiconductor circuit for signal transfer or scanning. As described in A. K. Ghosh, Tom Feng, J. Appl. Phys., 49 (12), 6982 (1978), such a photoconductive composition can also be used as a photoconductive layer, for solar cell.

The present azo compound can further be used as a photoconductive colored grains in photoelectrophoresis system or colored grains of dry or wet process electrophotographic developer.

As disclosed in JP-B-37-17162, and JP-A-55-19063, JP-A-55-161250 and JP-A-57-147656, a high resolution, durability and sensitivity printing plate and printed circuit can be prepared by dispersing the present azo compound in an alkali-soluble resin such as phenol resin together with the above described charge-transporting compound such as oxadiazole derivative and hydrazone derivative, coating the dispersion on an electrically conductive support such as aluminum, drying the coated material, exposing imagewise the material to light, subjecting the material to toner development, and then etching the material with an aqueous solution of an alkali.

The present invention will be further described in the following examples, but the present invention should not be construed as being limited thereto.

EXAMPLE 1

5 parts by weight of a tetrakisazo compound belonging to Compound Group No. 4-5 wherein A is No. A-1 and 5 parts by weight of a polyester resin (Vylon; Toyobo Co., Ltd.) were added to 50 parts by weight of tetrahydrofuran. The mixture was then subjected to dispersion in a ball mill over 12 hours. The dispersion was then coated on an electrically conductive support (Toray Industries Inc.'s Metalme 75TS; 75-μm polyethyleneterephthalate support comprising an aluminum-deposited film thereon) by means of a wire round rod, and dried to obtain a charge-generating layer having a thickness of about 0.5 μm.

A solution obtained by mixing 3.6 parts by weight of p-(diphenylamino)benzaldehyde-N'-methyl-N'-phenylhydrazone of the general formula:

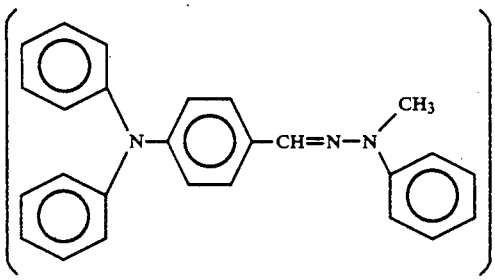

4 parts by weight of a polycarbonate resin (Panlite K-1300: Teijin Limited), 13.3 parts by weight of dichloromethane and 26.6 parts by weight of 1,2-dichloroethane was coated on the electric charge-generating layer by means of an applicator to form a charge-transporting layer thereon. Thus, an electrophotographic photoreceptor comprising a light-sensitive layer consisting of two layers was prepared.

The electrophotographic photoreceptor thus prepared was then evaluated for electrophotographic properties in a static process by means of a static copying paper tester (Kawaguchi Denki Seisakusho K.K.'s Model SP-428). Specifically, the photoreceptor was first measured for initial surface potential Vs developed shortly after being corona-charged (−6 kv) and surface potential Vo left after being stored in a dark place for 30 seconds. The photoreceptor was then exposed to light from a tungsten lamp in such a manner that the illuminance on the surface of the photoreceptor reached 3 lux. The photoreceptor was then measured for exposure $E_{50}$ such that the surface potential before exposure is attenuated to half the initial surface potential Vo and surface potential left 30 seconds after exposure (residual potential VR) This measurement process was repeated 3,000 times. The results are set forth in Table 3.

TABLE 3

| | $E_{50}$ (Lux · sec) | Vs (−V) | Vo (−V) | $V_R$ (−V) |
|---|---|---|---|---|
| 1st time | 2.0 | 900 | 780 | 0 |
| 3000th time | 2.0 | 880 | 770 | 0 |

EXAMPLES 2 TO 25

Two-layer electrophotographic photoreceptors were prepared in the same manner as in Example 1 except that the tetrakisazo compound was replaced by those set forth in Table 4. These specimens were then measured for $E_{50}$, Vs, Vo and $V_R$ in the same manner as in Example 1. The results are set forth in Table 4.

TABLE 4

| | A20 Compound | | 1st Time | | | | 3000th Time | | | |
|---|---|---|---|---|---|---|---|---|---|---|
| Example No. | Compound No. | Coupler No. | $E_{50}$ (Lux · Sec) | Vs (−V) | Vo (−V) | $V_R$ (−V) | $E_{50}$ (Lux · Sec) | Vs (−V) | Vo (−V) | $V_R$ (−V) |
| 2 | 2-2 | A-2 | 2.4 | 890 | 770 | 0 | 2.4 | 850 | 720 | 0 |
| 3 | 2-8 | A-14 | 2.6 | 910 | 770 | 0 | 2.6 | 860 | 710 | 0 |
| 4 | 2-26 | A-18 | 2.6 | 880 | 780 | 0 | 2.7 | 850 | 760 | 3 |
| 5 | 2-11 | A-24 | 2.0 | 930 | 810 | 0 | 2.0 | 910 | 805 | 1 |
| 6 | 2-15 | A-26 | 2.9 | 900 | 780 | 0 | 3.0 | 860 | 740 | 2 |
| 7 | 2-30 | A-92 | 2.1 | 880 | 750 | 0 | 2.1 | 830 | 710 | 1 |
| 8 | 2-51 | A-52 | 1.9 | 860 | 730 | 0 | 1.9 | 800 | 690 | 0 |
| 9 | 2-52 | A-53 | 2.8 | 900 | 740 | 1 | 2.9 | 830 | 670 | 3 |
| 10 | 2-54 | A-56 | 1.9 | 890 | 750 | 0 | 1.9 | 860 | 720 | 0 |
| 11 | 2-56 | A-1 | 2.2 | 920 | 800 | 0 | 2.2 | 860 | 730 | 0 |
| 12 | 2-58 | A-57 | 2.3 | 890 | 770 | 0 | 2.3 | 850 | 720 | 2 |
| 13 | 3-1 | A-38 | 1.6 | 900 | 710 | 0 | 1.6 | 840 | 660 | 0 |
| 14 | 3-2 | A-36 | 2.6 | 870 | 730 | 0 | 2.6 | 850 | 700 | 0 |
| 15 | 3-11 | A-32 | 1.8 | 930 | 810 | 0 | 1.8 | 900 | 780 | 0 |
| 16 | 3-12 | A-25 | 1.5 | 890 | 780 | 0 | 1.5 | 860 | 770 | 0 |
| 17 | 3-15 | A-16 | 1.5 | 920 | 800 | 1 | 1.5 | 890 | 780 | 2 |
| 18 | 3-15 | A-57 | 1.4 | 880 | 800 | 0 | 1.4 | 830 | 740 | 1 |
| 19 | 3-16 | A-61 | 2.0 | 920 | 790 | 1 | 2.1 | 860 | 740 | 3 |
| 20 | 4-1 | A-40 | 2.3 | 880 | 790 | 0 | 2.3 | 850 | 750 | 0 |
| 21 | 4-5 | A-57 | 1.6 | 900 | 790 | 0 | 1.6 | 870 | 760 | 0 |
| 22 | 4-5 | A-43 | 1.6 | 930 | 810 | 0 | 1.7 | 890 | 740 | 2 |
| 23 | 4-6 | A-49 | 2.9 | 860 | 730 | 0 | 3.0 | 830 | 710 | 5 |
| 24 | 4-12 | A-18 | 2.6 | 910 | 820 | 2 | 2.7 | 900 | 800 | 3 |
| 25 | 4-14 | A-3 | 2.8 | 870 | 750 | 0 | 2.8 | 850 | 740 | 0 |

EXAMPLE 26

5 parts by weight of a tetrakisazo compound belonging to Compound Group No. 4-5 wherein A is No. A-1, 40 parts by weight of the same hydrazone compound as used in Example 1 and 100 parts of a copolymer of benzyl methacrylate and methacrylic acid ([η] 30° C. in methyl ethyl ketone: 0.12; methacrylic acid content: 32.9%) were added to 660 parts by weight of dichloromethane. The mixture was then subjected to dispersion in a ball mill over 12 hours. The dispersion was then coated on a 0.25 mm thick grained aluminum plate, and dried to prepare an electrophotographic printing plate material comprising a 6 μm thick electrophotographic light-sensitive layer.

The specimen was then subjected to corona discharge at +6 kV in a dark place so that the light sensitive layer was charged at a surface potential of 500 V. The specimen was then exposed to light from a tungsten lamp with a color temperature of 2,854° K in such a manner that the illuminance on the surface of the specimen reached 2.0 lux. As a result, the specimen exhibited a half reduction exposure $E_{50}$ of 4.1 lux.sec.

The specimen was then charged at a surface potential of +500 V in a dark place. The specimen was then imagewise exposed to light with a transparent original of positive image brought into close contact thereto. The specimen was then immersed in a liquid developer comprising 1 l of Isoper H (petroleum solvent produced by Esso Standard), 5 g of finely dispersed polymethyl methacrylate (toner) and 0.01 g of soybean oil lecithin. As a result, a sharp positive toner image can be obtained.

The specimen was then heated to a temperature of 100° C. over 30 seconds to fix the toner image. The printing plate material was immersed in an etching solution obtained by dissolving 70 g of sodium metasilicate hydrate in 140 ml of glycerin, 550 ml of ethylene glycol and 150 ml of ethanol over 1 minute. The printing plate material was washed in a water flow with light brushing to remove the light-sensitive layer on the portion free of the toner. Thus, the desired printing plate was obtained.

The printing plate thus prepared was then used for printing by means of Hamada Star 600 CD Offset Printer. As a result, 50,000 sheets of extremely sharp printed matters free of any stain on the background were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising on an electrically conductive support a layer containing a charge-transporting compound and a charge-generating compound or a charge-transporting compound-containing layer and a charge-generating compound-containing layer, characterized in that as said charge-generating compound there is contained an azo compound containing an organic residue represented by formula (1):

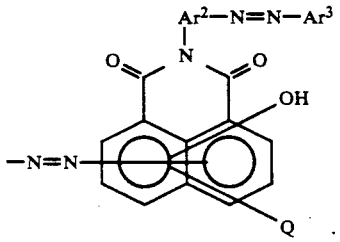

(1)

wherein $Ar^2$ represents a divalent aromatic hydrocarbon or aromatic heterocyclic group: $Ar^3$ represents an aromatic hydrocarbon group or aromatic heterocyclic group; and Q represents a hydrogen atom, halogen atom, alkyl group, trifluoromethyl group, nitro group, cyano group or alkoxy group.

2. An electrophotographic photoreceptor as in claim 1, wherein $Ar^2$ is selected from the group consisting of arylene, a divalent group derived from an aromatic hydrocarbon group, a divalent group derived from a condensed polycyclic aromatic group, and a divalent group derived from heterocyclic aromatic group.

3. An electrophotographic photoreceptor as in claim 1, wherein $Ar^3$ is selected from the group consisting of an aromatic hydrocarbon, and a heterocyclic aromatic group.

4. An electrophotographic photoreceptor in claim 1, wherein substituents for the aromatic hydrocarbon or heterocyclic group to which the organic residue represented by the general formula (1) may be connected, $Ar^2$ and $Ar^3$ are selected from the group consisting of a hydroxyl group, cyano group, nitro group, halogen atom, $C_{1-12}$ alkyl group, $C_{1-12}$ alkoxy group, trifluoromethyl group, trimethylsilyl group, methanesulfonyl group, amino group, $C_{1-12}$ alkylamino group, $C_{1-12}$ dialkylamino group, $C_{6-12}$ arylamino group, diarylamino group containing two $C_{6-15}$ aryl groups, $C_{6-12}$ arylazo group, carboxyl group, alkoxycarbonyl group containing $C_{1-18}$ alkoxy group, aryloxycarbonyl group containing $C_{6-16}$ aryloxy group, carboxylate of alkaline metal, sulfonate of alkaline metal, alkylcarbonyl group, $C_{1-12}$ alkylthio group, and $C_{1-12}$ arylthio group, wherein these substituents may be used singly or in combination and if a plurality of substituents are connected to the organic residue, $Ar^2$ or $Ar^3$, they may be the same or different and may be connected at any positions.

5. An electrophotographic photoreceptor as in claim 1, wherein the aromatic hydrocarbon or heterocyclic group contains a substituent comprising a substituted azo group represented by the general formula (3):

$$-N{=}N-Cp \qquad (3)$$

wherein Cp represents a known coupler residue which reacts with a diazonium salt.

6. An electrophotographic photoreceptor as in claim 1, wherein Q is selected form the group consisting of a $C_{1-18}$ alkyl group, trifluoromethyl group, nitro group, amino group, cyano group and $C_{1-8}$ alkoxy group, provided that any number of Q's can substitute on any carbon atoms in any positions in the organic residue.

7. An electrophotographic photoreceptor as in claim 1, wherein said azo compound is represented by formula (2):

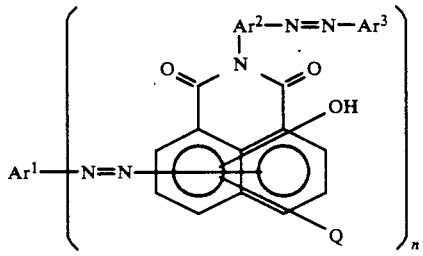

(2)

wherein $Ar^1$ represents an aromatic hydrocarbon group or aromatic heterocyclic group which may be connected via a connecting group; $Ar^2$ and $Ar^3$ are as defined in the general formula (1); and n represents an integer 1 to 4.

8. An electrophotographic photoreceptor as in claim 7, wherein the aromatic hydrocarbon group represented by $Ar^1$ is selected from the group consisting of a monovalent monocyclic or condensed polycyclic aromatic hydrocarbon group, a divalent monocyclic or condensed polycyclic aromatic hydrocarbon group and a perylene group.

9. An electrophotographic photoreceptor as in claim 7, wherein the aromatic hydrocarbon group represented by $Ar^1$ via a connecting group is selected from the group consisting of a bisphenylene group represented by the general formula:

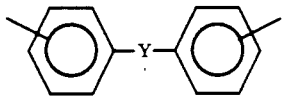

wherein Y represents —O—, —S—, —S—S—, —SO—, —$SO_2$—, —CONH—, —$CH_2$—, —CO—, —CH=CH—, —N=N—, —C≡C—, CH=CH— CH=CH— —CH=CH—CH=CH—,

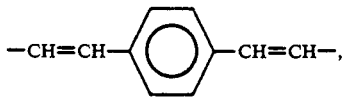

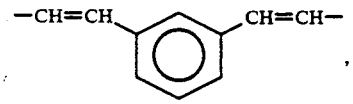

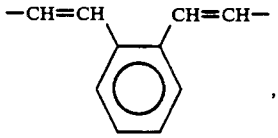

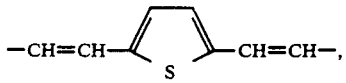

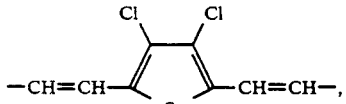

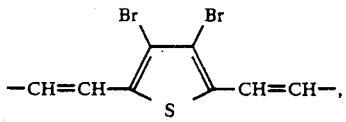

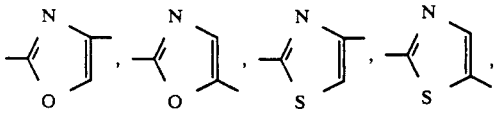

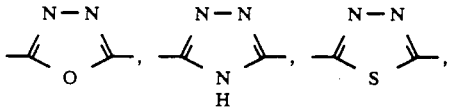

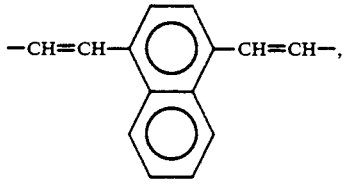

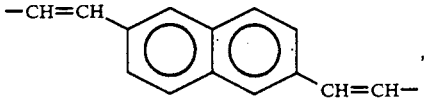

-continued

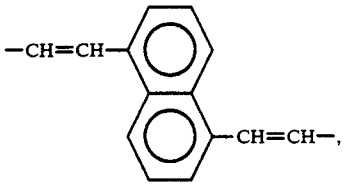

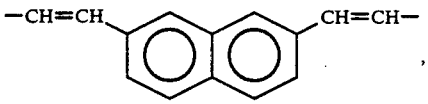

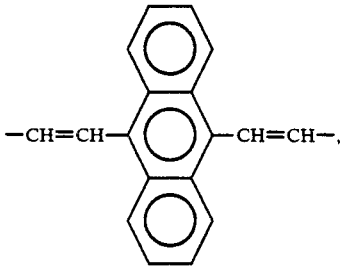

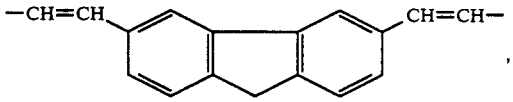

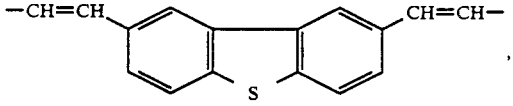

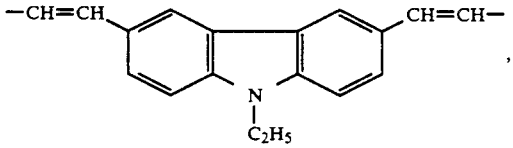

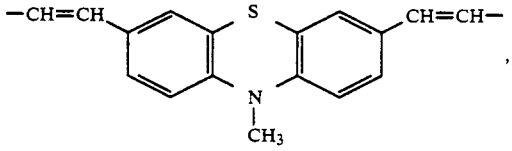

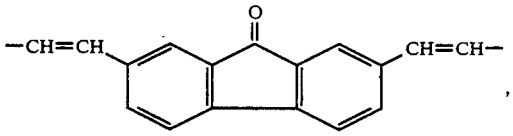

a xanthorenine group, a fluorenylene group, a trivalent group derived from triphenylamine, triphenylmethane, triphenylphosphate, triphenylphosphine oxide, 9-phenylsulforene and 4-diphenylaminotolan, and a tetravalent group derived from tetraphenylethylene, 4,4'-bis(diphenylamino)stilbene, 4,4'-bis(diphenylamino)tolan, bis-(4-diphenylaminophenyl)methane, 1,1-(4'-diphenylaminophenyl ether, and 4,4'-diphenylaminophenyl thioether.

10. An electrophotographic photoreceptor as in claim 7, wherein the aromatic heterocyclic group represented by $Ar^1$ is selected from the group consisting of a monovalent 9- to 20- membered heterocyclic group, a divalent 9- to 20- membered heterocyclic, a trivalent group derived from N-phenylcarbazole, N-phenylphenoxazi ne, N-phenylphenothi azine, triphenyloxazole, triphenylthiazole, triphenylimidazole, and triphenylselenazole, and a tetravalent group derived from 1,2-bis(N-carbazolyl)ethane and 1,4-bis(N-carbazolyl)benzene.

11. An electrophotographic photoreceptor as in claim 1, comprising on an electrically conductive support an electrophotographic light-sensitive layer with an azo compound dispersed in a binder or charge-transporting medium.

12. An electrophotographic photoreceptor as in claim 1, comprising on an electrically conductive support a charge-generating layer containing an azo compound as a main component and a charge-transporting layer provided thereon.

13. An electrophotographic photoreceptor as in claim 1, comprising on an electrically conductive support a charge-transporting layer and charge-generating layer containing an azo compound as a main component provided thereon.

* * * * *